US012638018B2

(12) United States Patent
Shi et al.

(10) Patent No.: US 12,638,018 B2
(45) Date of Patent: May 26, 2026

(54) AIR PUMP AND ACCESSORY THEREOF

(71) Applicant: MetaSee LLC, Austin, TX (US)

(72) Inventors: Qijie Shi, Shenzhen (CN); Mingrong Wen, Shenzhen (CN)

(73) Assignee: MetaSee LLC, TX (US)

( * ) Notice: Subject to any disclaimer, the term of this patent is extended or adjusted under 35 U.S.C. 154(b) by 0 days.

(21) Appl. No.: 19/281,109

(22) Filed: Jul. 25, 2025

(65) Prior Publication Data

US 2026/0110305 A1 Apr. 23, 2026

(30) Foreign Application Priority Data

Oct. 18, 2024 (CN) ..... 202411461999.X
Oct. 18, 2024 (CN) ..... 202422532388.1

(51) Int. Cl.
*F04D 25/06* (2006.01)
*F04D 29/42* (2006.01)

(52) U.S. Cl.
CPC ..... *F04D 25/0673* (2013.01); *F04D 29/4206* (2013.01)

(58) Field of Classification Search
CPC ..... F04D 25/0673; F04D 29/4206; F04D 25/084; F04D 13/068; F04D 17/16; F04D 25/08; F04D 25/0606; F04D 29/002; F04D 29/28; A47C 27/082; B25F 5/02; F04B 35/04; F04B 39/121; F04B 39/123
USPC ..... 417/423.14
See application file for complete search history.

(56) References Cited

U.S. PATENT DOCUMENTS 3,647,323 A * 3/1972 Thomas ..... H02K 7/14 415/206
5,127,808 A * 7/1992 Nichols ..... B62J 11/02 417/234
5,195,253 A * 3/1993 Poumey ..... A45D 20/04 392/382
5,890,882 A * 4/1999 Feldman ..... F04D 25/0673 5/713
5,938,410 A * 8/1999 Lee ..... A47L 5/24 417/423.2
12,338,808 B2 * 6/2025 Huang ..... F04B 39/0044
2008/0213089 A1 * 9/2008 McCurry ..... F04B 41/06 454/186
2018/0238314 A1 * 8/2018 Hong ..... F04B 39/127
2021/0289908 A1 * 9/2021 Lo ..... A45D 20/122
2022/0032439 A1 * 2/2022 Numata ..... B08B 5/02
2022/0196035 A1 * 6/2022 Numata ..... F04D 29/424
2025/0012264 A1 * 1/2025 Wu ..... F04B 35/01
2025/0027506 A1 * 1/2025 Zheng ..... F04D 25/084

* cited by examiner

*Primary Examiner* — Mark A Laurenzi
*Assistant Examiner* — Benjamin Doyle

(57) ABSTRACT

An air pump includes: a pump body defining a first opening and an air vent in different positions and an airflow channel in communication with the first opening and the air vent; a connector connected to the pump body and defining an inflation port; an airflow driving device arranged within the pump body. The airflow driving device is to perform one or more of the following operations: compressing air drawn into the pump body through the air vent and pump the air out through the inflation port; allowing the air to enter the pump body through the inflation port and be exhausted through the air vent; and driving the air to enter the pump body from the first opening, flow through the airflow channel and exit the pump body from the air vent.

20 Claims, 33 Drawing Sheets

AIR PUMP AND ACCESSORY THEREOF

CROSS REFERENCE TO RELATED APPLICATIONS

This application claims priority to Chinese Patent Application Nos. CN 202422532388.1 and CN 202411461999.X, both filed Oct. 18, 2024, which are hereby incorporated by reference herein as if set forth in their entirety.

TECHNICAL FIELD

The present disclosure generally relates to air pumps, and in particular relates to an air pump and air pump assembly that can function as both a vacuum and a duster.

BACKGROUND

An electric air pump is a widely used portable electronic device. It can inflate objects such as car tires, motorcycle tires, bicycle tires, footballs, and basketballs to a preset pressure using electric power.

However, some conventional electric air pumps tend to have limited functionality and cannot adequately meet the increasingly diverse needs of users. When other types of blowing or suction operations are required—such as blowing away fallen leaves or vacuuming air out of vacuum storage bags—additional blowing or suction equipment is often needed.

Therefore, there is a need to provide an air pump with more versatile functions to meet various usage requirements to overcome the above-mentioned problems.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
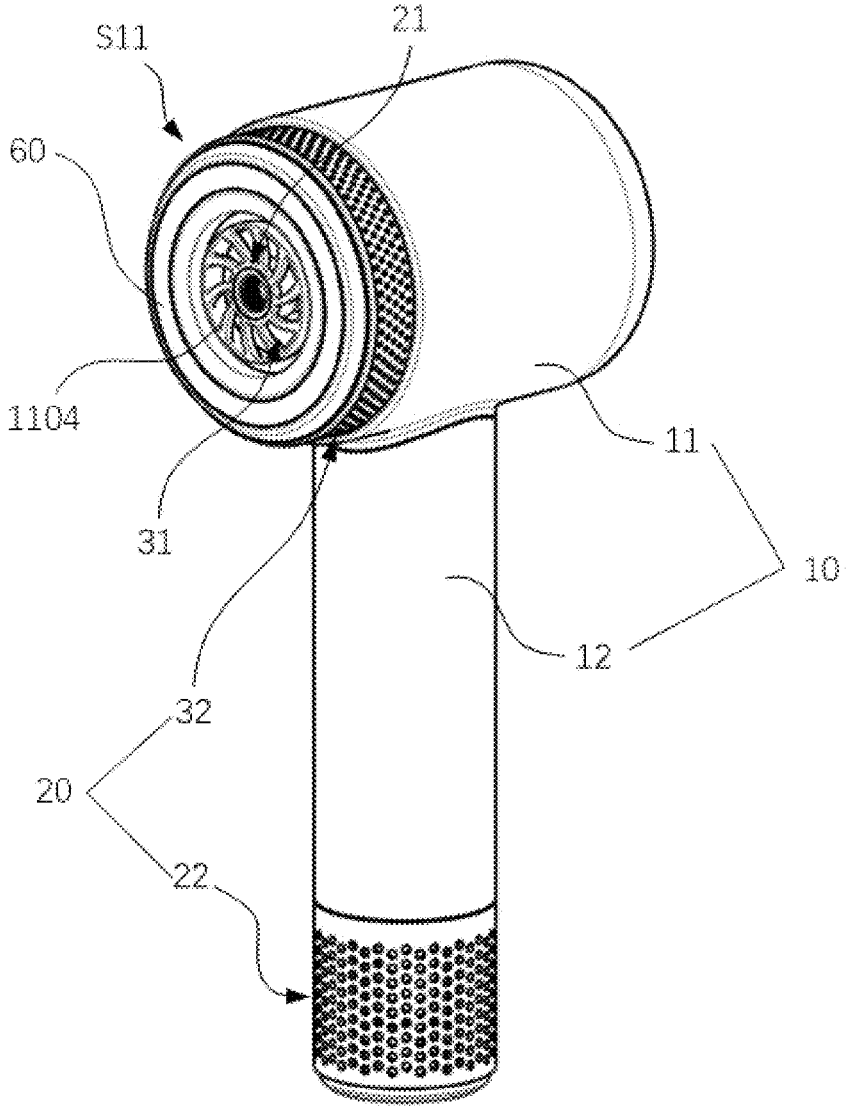
FIG. 1 is a schematic isometric view of an air pump according to one embodiment, showing a first end surface.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

It should be noted that, unless otherwise clearly specified and limited, that the orientation or position relations denoted by such terms as "central," "longitudinal," "latitudinal,"

"length," "width," "thickness," "above," "below," "front," "rear," "left," "right," "vertical," "horizontal," "top," "bottom," "inside," "outside," "clockwise," "counterclockwise," and the like are based on the orientation or position as shown in the accompanying drawings, and only used for the purpose of facilitating description for the present disclosure and simplification of the description, instead of indicating or suggesting that the denoted devices or elements must be specifically oriented, or configured or operated in some specific orientation. Thus, such terms should not be construed to limit the present disclosure. Such terms as "mount," "link," and "connect" should be understood as generic terms. For example, connection may refer to fixed connection, dismountable connection, or integrated connection; also to mechanical connection, electric connection, or intercommunication; further to direct connection, or connection by an intermediary medium; or even to internal communication between two elements or interaction between two elements.

In addition, such terms as "first" and "second" are only used for the purpose of description, rather than indicating or suggesting relative importance or implicitly indicating the number of the designated technical features. Accordingly, features defined with "first" or "second" may, expressly or implicitly, include one or more of such features. In the description of the present disclosure, "more" means two or above, and "and/or" includes any and all combinations of one or more related listed items, unless otherwise defined explicitly and specifically. For those of ordinary skill in the art, the specific meanings of the above terms in this application can be understood according to specific circumstances.

1. Definition

"End surface" refers to the surface formed at the ends of an object or structure along its main axial direction. It is located at both ends of the object or structure, and its shape depends on the overall shape and design of the object or structure.

"A number of" is an indefinite quantifier denoting one or multiple units. It may indicate a small or large quantity, emphasizing non-specificity in count and allowing flexibility for practical adjustments.

"Peripheral surface" refers to the continuous external surface of an object or structure, excluding its end surfaces. It serves as the interface between the object/structure and its surrounding environment.

"Airflow channel" refers to a specific path or spatial structure within an object or structure designed to guide and control the flow of air. It provides a physical space for air flow and includes a clearly defined air inlet and air outlet.

"Surround" refers to a structural element that encircles a particular structural element or area in all or part of the directions. It forms a fully or nearly fully enclosing state without implying a specific shape.

"Assembly" refers to the process of combining two or more separate parts or subassemblies according to a predetermined design and method to form a more complex functional unit or a complete product.

"Inflation function" refers to the capability of a device to deliver compressed air or gas in a controlled manner into a sealed container or system to achieve a specified high-pressure level. It is suitable for applications that require precise and high-pressure air delivery.

"Blowing function" refers to the capability of a device to generate a continuous airflow with low pressure but high volume. Compared to the inflation function, it focuses more on the volume of airflow rather than pressure output and is suitable for blowing away objects (e.g., dirt, dust, particles) or filling deformable containers.

"Suction function" refers to the capability of a device to create negative pressure or a vacuum to draw in and collect air, gas, or lightweight materials. It can be achieved by reversing the direction of airflow from the blowing function and is applicable to recycling deformable containers and cleaning tasks.

2. Regarding the Air Pump

Figure 2:
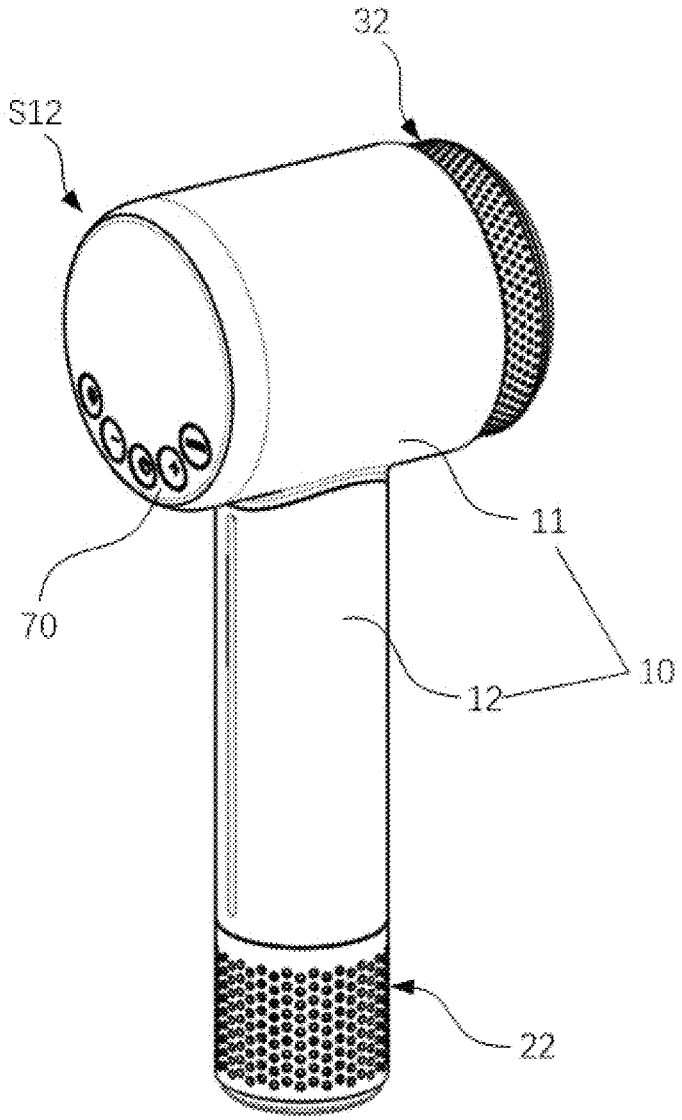
FIG. 2 is a schematic isometric view of the air pump viewed from a different perspective, showing the second end surface.
Figure 3:
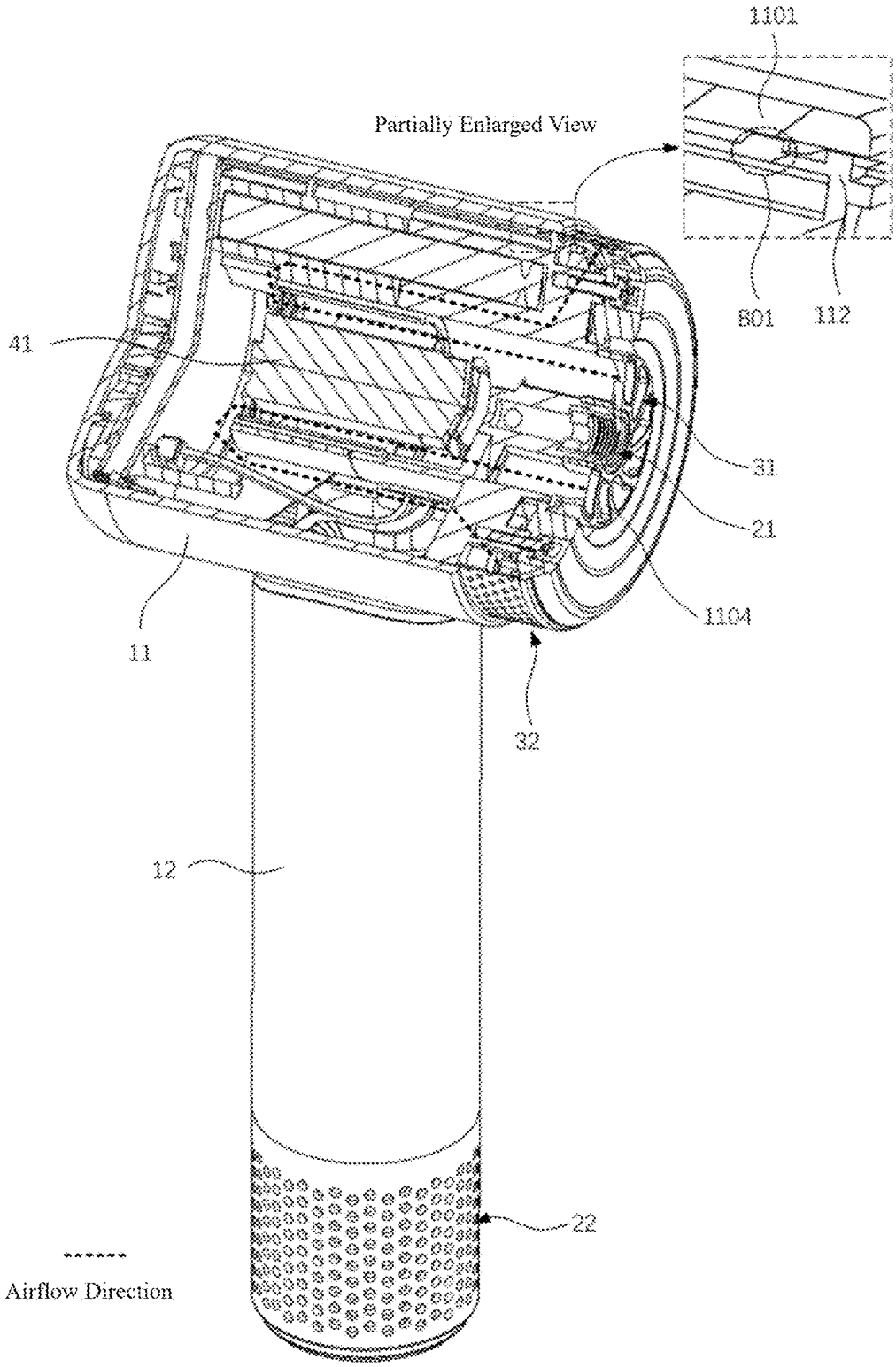
FIG. 3 is a partial cross-sectional view of the air pump, showing the airflow channel inside the pump body of the air pump.

FIG. 1 is a schematic isometric view of an air pump according to an embodiment of the present disclosure, shown from a front perspective. FIG. 2 is a schematic isometric view of the air pump according to an embodiment of the present disclosure, shown from a rear perspective. FIG. 3 is a cross-sectional view of the air pump according to an embodiment of the present disclosure.

The air pump features multifunctional capabilities. In addition to providing basic inflation function, it can switch between blowing and suction functions to meet the requirements of different usage scenarios.

As shown in FIGS. 1 and 2, the air pump includes a pump body 10 and a number of openings formed at different positions of the pump body 10.

The pump body 10 is the main structure of the entire air pump. It can be designed in any size and shape according to actual needs and may include one or multiple different structural components, which are not specifically limited here.

For example, the pump body 10 can be roughly divided into a main body 11 and a grip portion 12. The main body 11 is an elongated three-dimensional structure extending a certain length along an axis, while the grip portion 12 is a strip-like structure extending a certain length along another axis from the main body 11. Understandably, the construction of the pump body 10 is not limited to the aforementioned design and can be adjusted based on actual needs. For example, in another embodiment, unlike the T-shaped configuration shown in FIG. 1 where the main body 11 and the grip portion 12 extend perpendicularly to each other, the angle between their extending directions may be acute or obtuse. For example, the main body 11 and the grip portion 12 may form an inverted L-shaped (7-shaped) structure. In yet another embodiment, the grip portion 12 may have a curved (arc-shaped) configuration.

In the present disclosure, since the main body 11 is the primary part of the entire pump body 10, the axial direction of the main body 11 is referred to as the "main axis." The two end surfaces of the main body 11 that face away from each other along the main axis are referred to as the first end surface S11 and the second end surface S12, respectively.

Specifically, as shown in FIGS. 1 and 2, there is an angle between the extension direction of the grip portion 12 and the main axis, resulting in a corresponding inclination between the grip portion 12 and the main body 11. This design allows the user to hold the air pump more comfortably during use. For example, the extension direction of the grip portion 12 may form an angle of approximately 90° with the main axis of the main body 11.

It should be noted that other suitable preset angles may be selected according to actual needs, or an angle adjustment mechanism may be provided to enable the inclination angle between the grip portion 12 and the main body 11 to be adjustable.

The above-mentioned openings are through holes that allow air to pass through, enabling air to enter or exit the pump body. Depending on their positions and specific functions, these openings can be classified into an air vent 20, an inflation port 21, and a first opening 31.

The air vent 20 and the inflation port 21 work together as openings for achieving the inflation function. A continuous air duct is formed between the air vent 20 and the inflation port 21, allowing external air to enter the interior of the pump body 10. After being compressed, the air exits the pump body at a predetermined pressure.

The air vent 20 further cooperates with the first opening 31 to perform the blowing/suction function. When the suction function is activated, the air inside the pump body is rapidly exhausted through the air vent 20, thereby creating a certain negative pressure at the first opening 31, which draws external air into the pump body. When the blowing function is activated, external air is drawn into the pump body through the air vent 20, and a relatively fast airflow is generated and expelled from the first opening 31.

In addition, the air vent 20 formed on the pump body enables air exchange between the interior and exterior of the pump body. Through this air exchange, the heat generated by internal components and functional modules can be dissipated more quickly, thereby achieving an effective cooling effect.

In one embodiment, the air vent 20 may include an air inlet 22 and a second opening 32. The air inlet 22 cooperates with the inflation port 21 to perform the inflation function, while the second opening 32 works together with the first opening 31 to achieve the blowing/suction function.

The air inlet 22 and the second opening 32 together form a heat dissipation vent, which performs a corresponding cooling function by facilitating air exchange between the interior and exterior of the inflation body.

The above-mentioned various openings can be selectively arranged at any suitable positions on the pump body 10 according to actual needs, thereby achieving different corresponding effects.

It should be noted that the arrangement and structure of the air vent 20 are not limited to the descriptions above and may be modified as needed. For example, in another embodiment, the air vent 20 may be provided on the second end surface S12.

For example, as shown in FIGS. 1 and 2, the air inlet 22 may be arranged at the bottom of the grip portion 12 to avoid unnecessary obstruction during the operation of the air pump. Alternatively, as further illustrated in FIGS. 1 and 2, the second opening 32 may be provided on the peripheral surface of the main body 11 and arranged around the main axis. This configuration facilitates the movement of air between the first opening 31 and the second opening 32, reduces the structural complexity of the airflow passage connecting the first and second openings, and helps achieve improved blowing/suction performance.

In one embodiment, the first opening 31 and the inflation port 21 are arranged on the same end surface of the pump body. For example, as shown in FIGS. 1 and 2, both the first opening 31 and the inflation port 21 are positioned on the first end surface S11 of the pump body. In this arrangement, the inflation port 21 is located at the center of the first end surface S11, while the first open end 31 includes a number of first through holes 310 (see FIG. 17) surrounding the inflation port 21. It should be noted that the arrangement of the first opening 31 and the inflation port 21 is not limited to the configuration described above and may be modified as needed. For instance, in another embodiment, the inflation port 21 and the first opening 31 are not positioned on the same end surface of the pump body 10. Specifically, the first opening 31 may remain in the position shown in FIG. 1, while the inflation port 21 may be arranged on the peripheral surface of the main body 11, or alternatively, on the second end surface S12 of the main body 11, which is opposite to the first end surface S11 where the first opening 31 is located. In yet another embodiment, the inflation port 21 and the first opening 31 are arranged on the same end surface of the pump body 10; however, the first opening 31 does not surround the inflation port 21.

By arranging the first opening 31 and the inflation port 21 on the same end surface, the openings required for the inflation, suction, and blowing functions are all positioned on a single surface. This configuration facilitates user operation and also enables a more compact structural design.

FIG. 3 exemplarily illustrates an airflow channel provided within the pump body 10, which is in communication with the aforementioned first opening 31 and second opening 32. It should be noted that, those skilled in the art may adjust the physical shape, dimensions, and extension path of the airflow channel C as needed, and such modifications are not limited to the configuration shown in FIG. 3, as long as the channel enables communication between the first opening 31 and the second opening 32.

The "airflow driving device" is a general term for the relevant structures and components that provide the driving force for the movement or flow of air within the pump body. It is fully housed inside the pump body 10 and is capable of performing inflation, deflation, suction, or blowing functions based on external operation commands applied by the user.

For example, when performing the inflation function, the airflow driving device compresses the air drawn in through the air inlet 22 and pumps the compressed air—at a desired pressure—out through the inflation port 21. When performing the deflation function, the airflow driving device may allow air from an object connected to the inflation port 21 (such as a football, basketball, bicycle tire, car tire, etc.) to flow into the pump body 10 through the inflation port 21 and be exhausted through the air vent (specifically the air inlet 22). When performing the air extraction function, the airflow driving device may draw air from the object (e.g., a football, basketball, bicycle tire, car tire, etc.) connected to the inflation port 21 through the inflation port 21, and exhaust it via the air vent (specifically the air inlet 22), thereby accelerating the deflation process. It should be noted that this function requires the airflow driving device to include a two-way electric air pump. When performing the suction function, the airflow driving device provides a forward driving force to draw in external air through the first opening 31 and drive the air to flow through the airflow channel, and exhaust it through the second opening 32. In contrast, when performing the blowing function, the airflow driving device provides a reverse driving force to draw in air through the second opening 32 and drive the air to flow through the airflow channel, and exhaust it through the first opening 31.

Therefore, by further adding a new airflow driving device, a first opening, a second opening, and an airflow channel in communication with the first and second openings based on a conventional air pump, the air pump of the present disclosure can be endowed with inflation, deflation, blowing, and suction functions. This enhanced functionality better meets users' needs for a versatile and portable device. In one embodiment, the airflow driving device can perform the inflation, deflation, blowing, and suction operations in response to different commands from a user. In another embodiment, the airflow driving device can be configured with at least one of the inflation, deflation, blowing, and suction functions. In one example, the airflow driving device can be configured with any two of the inflation, deflation, blowing, and suction functions. In another example, the airflow driving device can be configured with any three of the inflation, deflation, blowing, and suction functions. In yet another example, multiple airflow driving devices can be employed, and each of the airflow driving devices may be configured with at least one of the inflation, deflation, blowing, and suction functions.

3. Regarding the Airflow Driving Device

Figure 4:
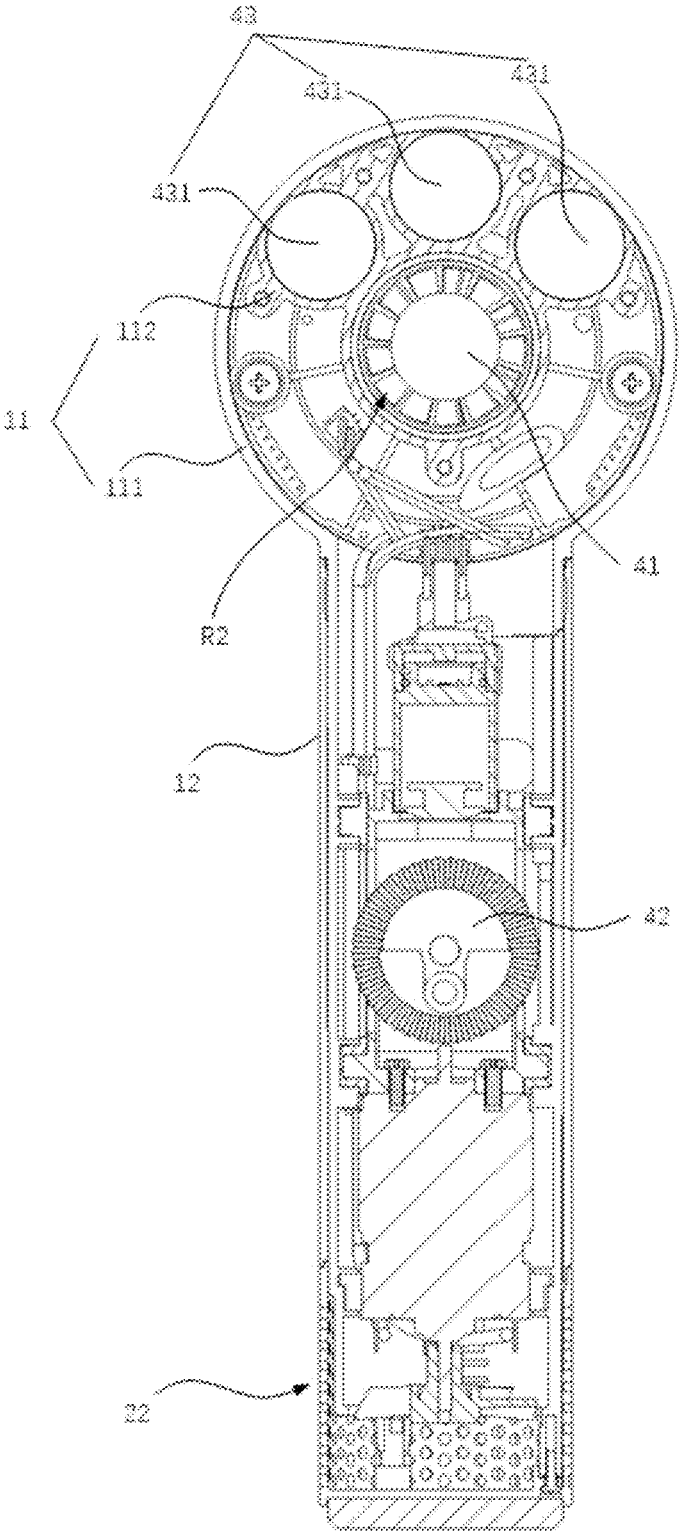
FIG. 4 is a cross-sectional view of the air pump.

FIG. 4 is a cross-sectional view of the air pump according to an embodiment of the present disclosure. In one embodiment, as shown in FIG. 4, the airflow driving device may include a first air driving module 41, a second air driving module 42, and an energy storage module 43.

The first air driving module 41 is a power component designed to perform the blowing and suction functions. It may employ any suitable type of fan device as needed. For example, in one embodiment, the first air driving module 41 includes a blower/suction fan (such as an axial flow fan) equipped with a motor and fan blades. This fan is capable of operating in both blowing and suction modes. In the blowing mode, the motor drives the fan blades to rotate at high speed, thereby expelling air outward. In the suction mode, the motor similarly drives the fan blades at high speed to generate negative pressure in a localized area (i.e., near the first opening 31) of the pump body 10, allowing external air to be drawn in. Accordingly, the first air driving module 41 can drive air to enter the pump body 10 through the first opening 31, flow through the airflow channel, and exit the pump body 10 through the second opening 32, or vice versa—enter the pump body 10 through the second opening 32, flow through the airflow channel, and exit the pump body 10 through the first opening 31. With this configuration, the air pump equipped with the first air driving module 41 can function as a cleaning device with a dust-blowing feature and can inflate products that do not require high pressure (such as air mattresses). In some scenarios, the air pump may even be used for vacuuming purposes, although it is not specifically designed as a dedicated vacuum cleaner.

The second air driving module 42 is a power component designed to perform the inflation function. It may utilize any suitable type or model of air pump mechanism depending on actual requirements, such as a vane-type or piston-type pump core. In one embodiment, the second air driving module 42 includes an inflation motor, a transmission mechanism, and a cylinder. The input end of the transmission mechanism is connected to the motor shaft of the inflation motor, and the output end is connected to the first end of a piston rod, whose second end is connected to a piston housed within the cylinder body. Driven by the motor shaft of the inflation motor, the transmission mechanism causes the piston rod to oscillate back and forth, which in turn drives the piston to reciprocate within the cylinder body. External air enters the pump body 10 through the air inlet 22 and flows into the cylinder. As the piston moves inward, it compresses the air inside the cylinder body, and the compressed air is then pumped out through the inflation port 21 at a predetermined pressure. It should be noted that the configuration of the second air driving module 42 is not limited to the configuration described above and may be implemented using other known types of inflation cores as needed.

It should be noted that the second air driving module 42 may be configured to operate under different air pressure output modes, thereby allowing users to select different output air pressures according to the specific object to be inflated. Typically, the output air pressure of the second air driving module 42 is greater than 3 pounds psi (per square inch). For example, for a basketball, the second air driving module 42 may output an air pressure of 8 psi; for a football, it may output 10 psi. For tires such as bicycle tires or automobile tires, the second air driving module 42 may output an air pressure ranging from 100 to 150 psi. The first air driving module 41 is a low-pressure fan device. The air pressure of air either drawn in from or blown out through the first opening 31 under the drive of the first air driving module 41 is lower than the air pressure of the air pumped out from the inflation port 21 under the drive of the second air driving module 42. In other words, the air pressure of the air either drawn in from or blown out through the first opening 31 by the first air driving module 41 is generally less than 2 psi. It should be noted that although the first air driving module 41 is a low-pressure fan device, in another embodiment, the output pressure ranges of the first air driving module 41 and the second air driving module 42 may overlap. However, the maximum output pressure achievable by the first air driving module 41 is lower than that of the second air driving module 42.

The energy storage module 43 is a device capable of storing electrical energy through chemical energy conversion. For instance, it may include a battery pack formed by connecting multiple battery cells in series and/or parallel, serving as the power source for the air pump to supply electricity to both the first air driving module 41 and the second air driving module 42.

Specifically, in order to make efficient use of space, the pump body 10 is designed to be as compact and space-saving as possible. As further shown in FIG. 4, the first air driving module 41 and multiple battery cells 431 may be arranged within the main body 11, while the second air driving module 42 may be arranged within the grip portion 12.

Accordingly, the second air driving module 42 can compress air drawn into the pump body 10 through the air inlet 22 located at the end of the grip portion 12, and pump the compressed air out through the inflation port 21.

Alternatively, the arrangement positions of the first air driving module 41 and the second air driving module 42 described above may be interchanged. For example, the first air driving module 41 may be disposed in the grip portion 12, while the second air driving module 42 may be disposed in the main body 11.

Furthermore, as shown in FIG. 4, the first air driving unit 41 may be arranged along the main axis, and the multiple battery cells 431 may be arranged around the first air driving module 41, thereby providing a more compact main body 11.

Accordingly, the first air driving module 41 may generate a forward or reverse driving force to drive airflow through the internal airflow channel of the main body 11, thereby forming negative pressure suction or air blowing at the first opening 31.

Alternatively, one of the aforementioned first air driving module and second air driving module may be omitted. For example, when a single air driving module has sufficiently strong performance and is capable of supporting a wide range of air pressure adjustments, the airflow driving device may include only a single air driving module and a corresponding energy storage module.

Accordingly, the air driving module may, based on externally applied control instructions, drive air to enter the pump body 10 from the first opening 31, flow through the airflow channel, and exit the pump body 10 from the second opening 32, or drive air to enter the pump body 10 from the second opening 32, flow through the airflow channel, and exit the pump body 10 from the first opening 31, or compress the air drawn into the pump body 10 through the air inlet 22 and pump the compressed air out through the inflation port 21.

4. Regarding the Main Body of the Pump Body

Figure 5:
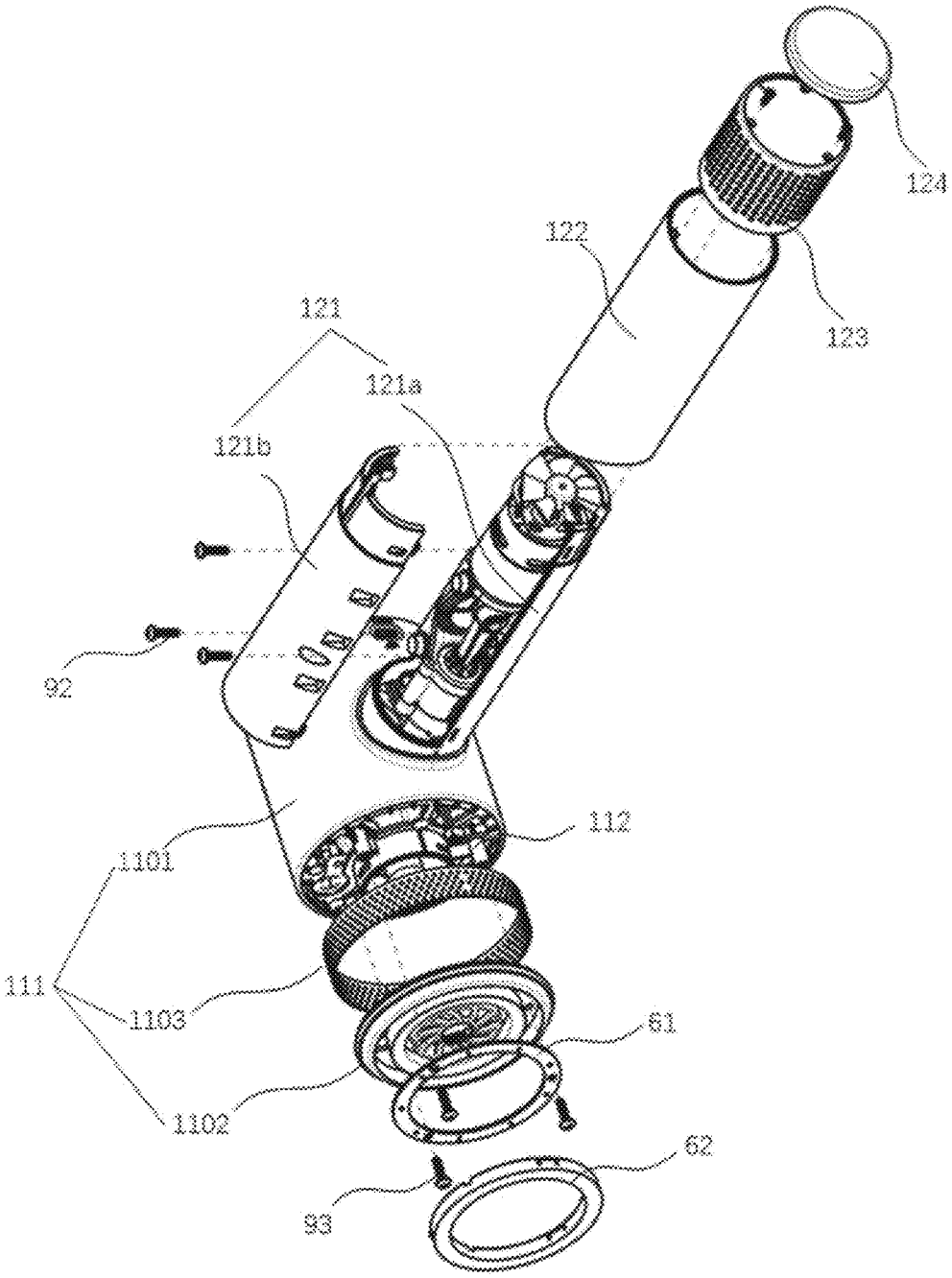
FIG. 5 is an isometric exploded view of the air pump.
Figure 6:
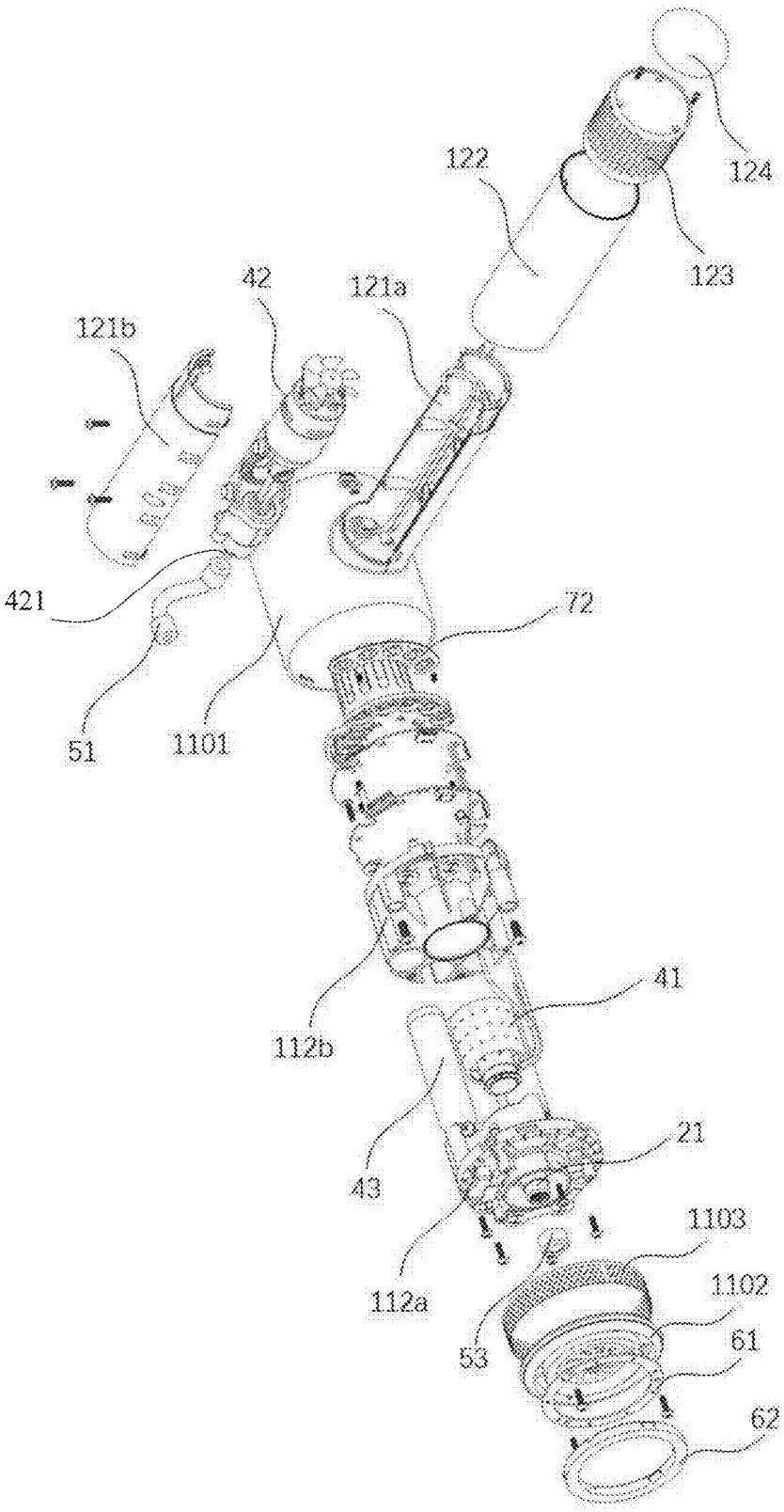
FIG. 6 is another isometric exploded view of the air pump.

FIG. 5 is a partial exploded view of the air pump according to an embodiment of the present disclosure. FIG. 6 is an exploded view of the air pump according to an embodiment of the present disclosure.

In one embodiment, as shown in FIG. 5, the main body 11 includes a housing 111 and a support member 112. The housing 111 provides the outer surface of the main body 11. It serves to enclose and protect the internal components and defines the external contour of the air pump. The housing 111 may be designed with an appropriate thickness, size, and shape according to practical requirements, thereby providing a suitable internal accommodation space. For example, FIG. 5 illustrates a generally cylindrical shape.

Specifically, and with continued reference to FIG. 5, the housing 111 may be assembled from a housing body 1101, a cover plate 1102, and a connecting ring 1103.

One end of the housing body 1101 is open, forming an internal accommodating space for receiving and placing the support member 112. The support member 112 is assembled and fixed inside the housing body 1101. The cover plate 1102 is fixed to an end of the support member 112. The connecting ring 1103 is positioned between the housing body 1101 and the cover plate 1102.

The connecting ring 1103 is joined to the open end of the housing body 1101 and to the cover plate 1102 on opposite sides along the main axis, thereby forming a complete housing 111 that encloses the support member 112.

Accordingly, the cover plate 1102 constitutes the first end surface S11 of the pump body, while the closed end of the housing body 1101 opposite the open end constitutes the second end surface S12 of the pump body. The connecting ring 1103 is a structural component provided with multiple through holes (for example, a metal ring with mesh openings), and these through holes form the aforementioned second opening 32.

The support member 112 is housed and secured within the housing 111, and serves as a structural framework for mounting and supporting various functional components. In the present disclosure, the space formed by the support member 112 for securing and accommodating functional components is referred to as a mounting position.

For example, the support member 112 may define a first mounting position for accommodating the first air driving module 41, and a second mounting position for accommodating the battery cells 431. The number of second mounting positions corresponds to the number of battery cells.

In addition, at least a portion of the support member 112 is physically connected to the housing 111 to ensure that the support member 112 remains securely fixed within the housing 111. For example, as shown in FIG. 3, a portion of the support 112 may be engaged with the housing 111 via a first latch B01, so that the support member 112 is fixedly connected to the housing 111.

Furthermore, the support member 112 cooperates with the housing 111 to form the desired airflow channel. For instance, as illustrated in FIG. 8, the support member 112 may be provided with ventilation holes 1123 that allow air to pass through, thereby forming the aforementioned airflow channel.

Moreover, these ventilation holes 1123 give the support member 112 a hollowed-out structural design, which also helps reduce the overall material weight of the support member 112.

Figure 7:
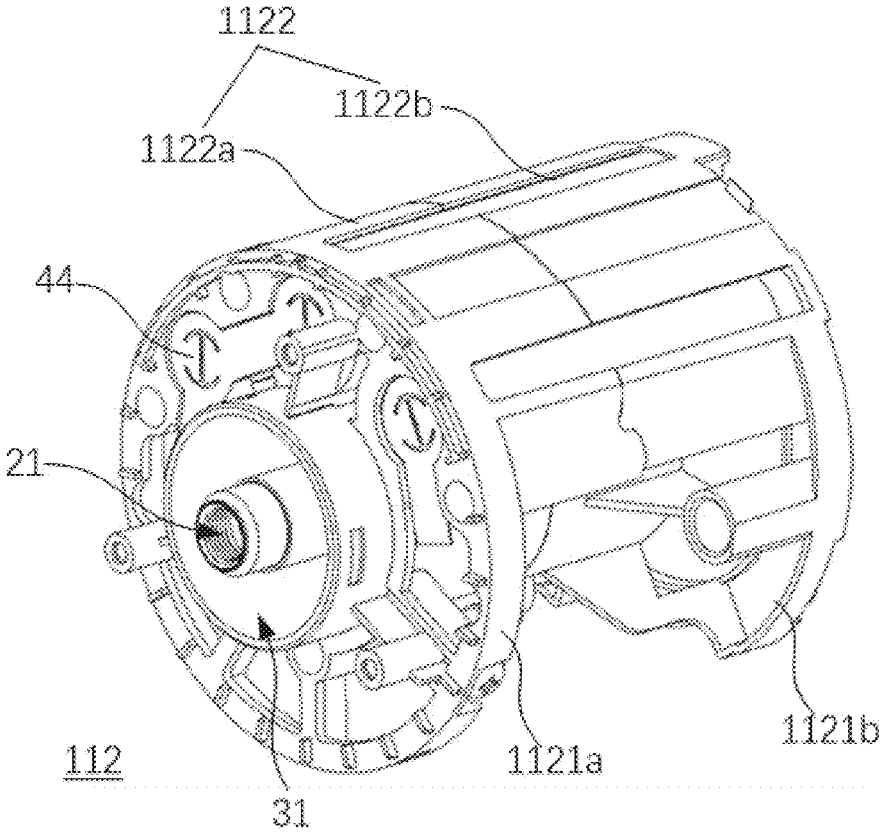
FIG. 7 is a schematic isometric view of the support member of the air pump according to one embodiment.
Figure 8:
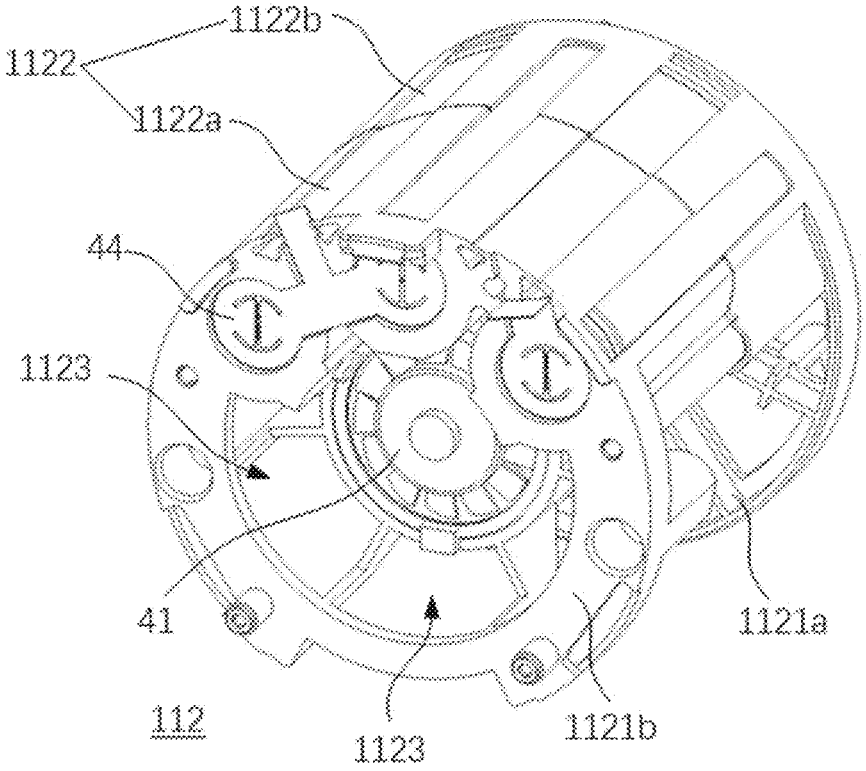
FIG. 8 is a schematic isometric view of the support member of the air pump viewed from a different perspective.

Specifically, as shown in FIGS. 7 and 8, the support member 112 may include a first end member 1121*a*, a second end member 1121*b*, and a spacer member 1122 located between the first and second end members.

The first end member 1121*a* is the part adjacent to the first end surface of the pump body, while the second end member 1121*b* is the part adjacent to the second end surface of the pump body. The spacer member 1122, which extends along the main axis, forms the aforementioned first mounting position and second mounting position, respectively configured to house the first air driving module 41 and the battery cells 431.

The multiple battery cells 431, spaced apart from one another, may be electrically connected in series or parallel via electrical connectors 44, thereby forming a complete energy storage module capable of providing and outputting the required voltage.

Based on the positional arrangement of the support member 112 described above, in one embodiment, and with continued reference to FIG. 7, the inflation port 21 may be disposed at the center of the first end member 1121*a*. Correspondingly, the cover plate 1102 is provided with a through hole adapted to the position of the inflation port 21, allowing a connecting tubing (e.g., a hose) or similar external accessory to be removably and sealingly connected to the inflation port 21 for inflating a target object.

In one embodiment, as shown in FIG. 6, a shock-absorbing pad 53 may be interposed between the lateral surface of the connector 210 that defines the inflation port 21 and the cover plate 1102. The shock-absorbing pad 53 is made of an elastic material (e.g., soft rubber or other flexible materials) and is arranged around the lateral surface of the connector 210, thereby forming an elastic buffer layer between the connector 210 and the cover plate 1102. The buffer layer formed by the shock-absorbing pad 53 helps prevent noise generation during inflation by reducing vibration-induced collisions between the two components.

In another embodiment, and with continued reference to FIG. 7, the first opening 31 may be disposed at the first end member 1121*a*, and may be implemented through a central hole formed in the first end member 1121*a*. Correspondingly, the cover plate 1102 is provided with a grille 1104 (see FIG. 1) in the area aligned with the central hole of the first end member 1121*a*, so as to guide air smoothly through the first opening 31.

In one embodiment, as shown in FIG. 1, the grille 1104 may be composed of a number of radially arranged bars. These bars extend outward from a ring of the cover plate 1102 that is arranged around the central inflation port 21 and are angled in their direction of extension rather than being completely straight.

Accordingly, when airflow passes through the grille 1104, the inclined bars can guide the airflow to generate a rotational motion, thereby enabling the airflow to be more evenly distributed across the entire first opening 31, effectively improving airflow uniformity and reducing airflow noise.

5. Regarding the Grip Portion of the Pump Body

In one embodiment, please refer to FIG. 5, the grip portion 12 may include an inner case 121, an outer case 122, a connecting ring 123, and an end cover 124. The inner case 121 is a housing component that encloses the second air driving module 42, providing an internal space that fits the second air driving module 42. Exemplarily, FIG. 5 illustrates a half case 121*a* of the inner case 121 being integrally formed with the main body 111, while another separate half case 121*b* is fixedly connected to the half case 121*a* by screws 92. Alternatively, the half case 121*b* may be fixed to the half case 121*a* by snap-fit structures, adhesive bonding, or other suitable means.

The outer case 122 is arranged around the inner case 121, forming the main external surface of the grip portion 12. The connecting ring 123 may be a mesh structure with multiple through holes (e.g., a ring-shaped metal mesh) to form the air inlet 22 described above. The connecting ring 123 may be locked and fixed to the inner case 121 by screws or any other suitable fastening method. In this way, it can serve to prevent the outer case 122 from detaching, thereby securing its position. The end cover 124 is fixedly attached to and covers the bottom end of the connecting ring 123, completing the structure of the grip portion 12.

6. Regarding the Support Member

Figure 9:
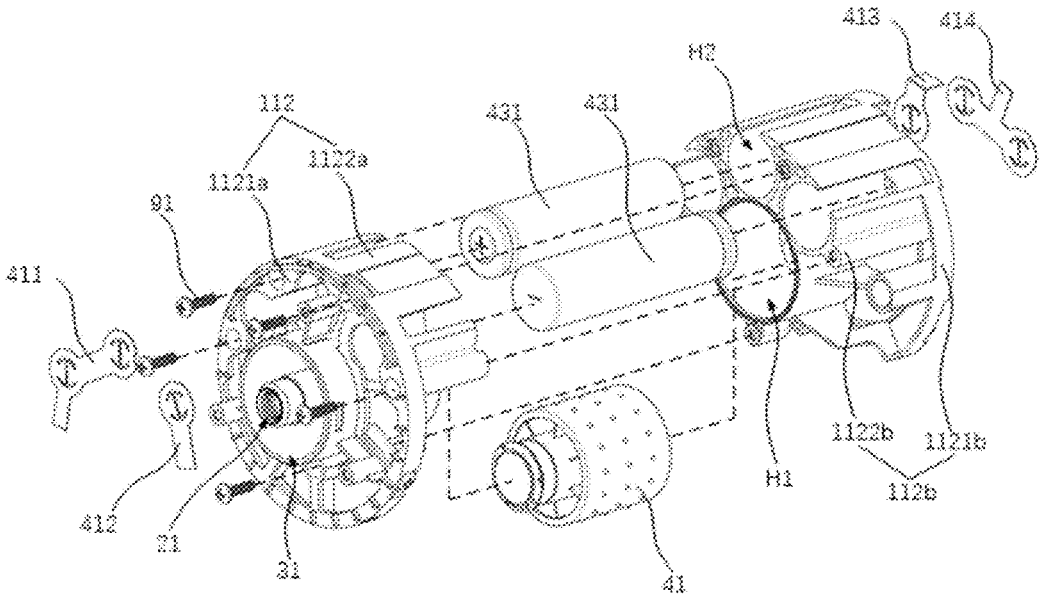
FIG. 9 is an isometric exploded view of the support member.

FIG. 9 is an isometric exploded view of the support member according to an embodiment of the present disclosure. As shown in FIG. 9, the support member 112 may include a first cell support 112*a* and a second cell support 112*b*. The first cell support 112*a* and the second cell support 112*b* are structurally designed to mate with each other, and are fixedly connected by any suitable type of fastening means (in FIG. 9, the connection is exemplarily shown as being secured by screws 91) to form the support member 112.

The first cell support 112*a* includes the first end member 1121*a* and a first spacer member 1122*a*. Similarly, the second cell support 112*b* includes the second end member 1121*b* and a second spacer member 1122*b*. The first spacer member 1122*a* and the second spacer member 1122*b* respectively provide a mounting hole H1 along the main axis, as well as several cell slots H2 (FIG. 9 exemplarily shows a case where three cell slots are provided) arranged around the mounting hole. The mounting hole H1 and each cell slot H2 are holes separated from one another.

Accordingly, when the first cell support 112*a* and the second cell support 112*b* are fixedly connected to each other—such that the two opposing ends of the first spacer member 1122*a* and the second spacer member 1122*b* are joined together—the mounting holes formed by the two spacer members cooperate to define the first mounting position for installation of the first air driving module 41. Likewise, the corresponding cell slots formed by the two spacer members cooperate to define the second mounting position for installation of the battery cells 431.

Alternatively, in cases where the battery cells and the first air driving module have specific axial lengths, the first spacer member 1122*a* and the second spacer member 1122*b* may remain slightly separated, without direct end-to-end contact, as long as the battery cells and the first air driving module can be securely clamped and fixed between the first and second cell supports.

Specifically, both the first and second mounting positions formed within the support member 112 are arranged along the axial direction of the pump body. As a result, the battery cells 431 fixed in the second mounting position are aligned along the same axis, thereby stabilizing the center of gravity of the entire pump body, facilitating handheld operation, and enhancing the overall user experience of the air pump.

7. Regarding the Illumination Function of the Air Pump

In one embodiment, please refer to FIG. 1, the air pump may further include an additional lighting device 60 disposed on the first end surface S11 of the pump body, providing illumination for the user. Accordingly, when the lighting device 60 is turned on, it emits light to illuminate the area in front of the first end surface S11 of the air pump. This design also facilitates the user in dark environments when connecting other accessories to the inflation port or the first opening provided at the first end surface S11.

Specifically, as shown in FIG. 5, the lighting device 60 may include a light circuit board 61 and a light cover 62. The light circuit board 61 is fixed to the first end member 1121*a* and arranged around the first opening 31. The light cover 62 has a size adapted to the light circuit board 61 and is arranged over the light circuit board 61 by being fixedly connected to the cover plate 1102, serving to protect the light circuit board 61 and concentrate the light it emits.

Exemplarily, FIG. 5 illustrates a ring-shaped light circuit board 61 and light cover 62. However, it will be understood by those skilled in the art that other suitable shapes or sizes of light circuit boards and light covers may be used as required by specific applications.

In addition, FIG. 5 further illustrates that the light circuit board 61 is secured to the end member of the support member 112 by means of screw fastening using screws 93, while the light cover 62 is fixedly connected to the cover plate 1102 by means of snap-fit connection. However, it will be understood by those skilled in the art that any other suitable type of fastening method may be employed to achieve the fixed connection among the light circuit board, light cove, cover plate, and end member.

Alternatively, other similar structures may be used to implement the lighting device 60, and the present disclosure is not limited to the configuration shown in FIG. 5. For example, the cover plate 1102 and the light cover 62 may be integrally formed as a single unit, with a corresponding transparent region formed on the cover plate 1102 to serve the function of a ring-shaped light cover.

8. Regarding the Interaction Components of the Air Pump

Figure 13:
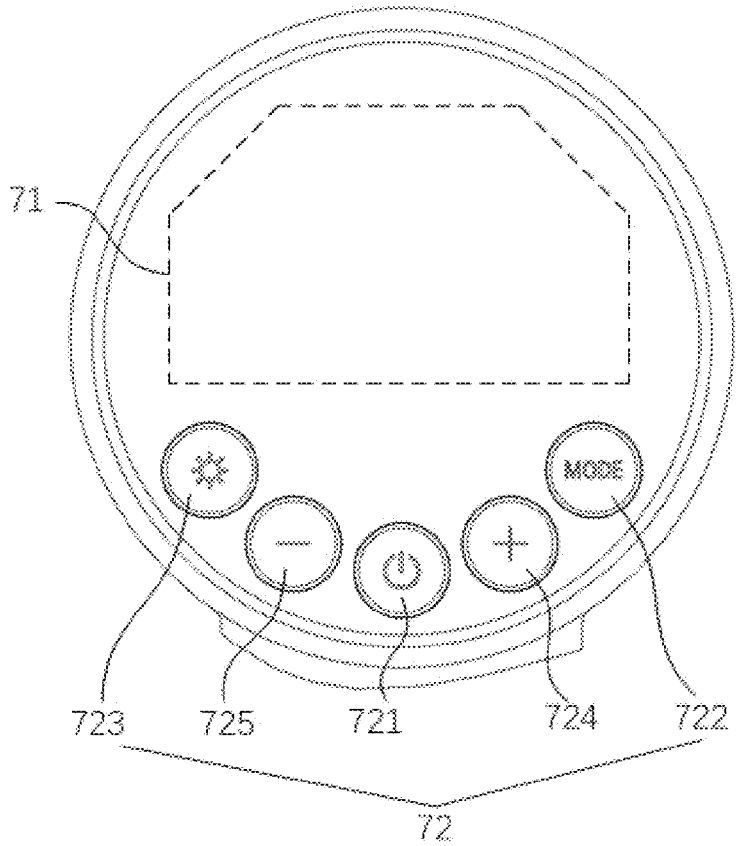
FIG. 13 is a schematic view of interaction components according to one embodiment.

Referring to FIG. 2, in one embodiment, the air pump further includes a number of interaction components 70 disposed on the second end surface S12 of the pump body. The interaction components 70 serve as functional elements that enable interaction between the user and the air pump. Acting as an input interface, they allow the user to input data, issue commands, and receive feedback from the air pump. For example, as shown in FIG. 13, the interaction components 70 may include a display area 71 for providing visual feedback and control buttons 72 for receiving user inputs and commands.

Figure 11:
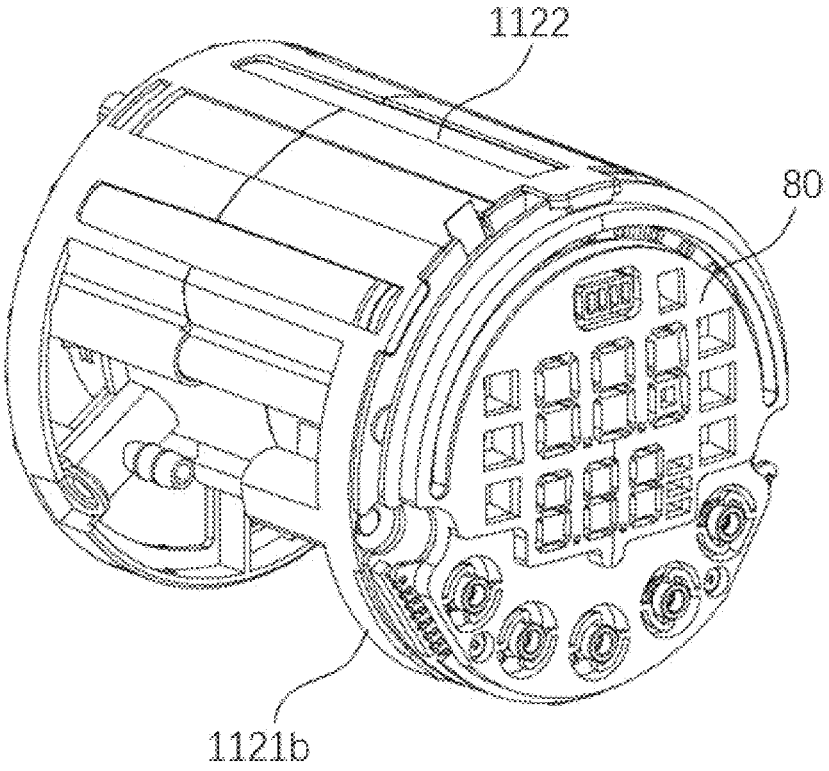
FIG. 11 is another schematic isometric view of the support member.
Figure 12:
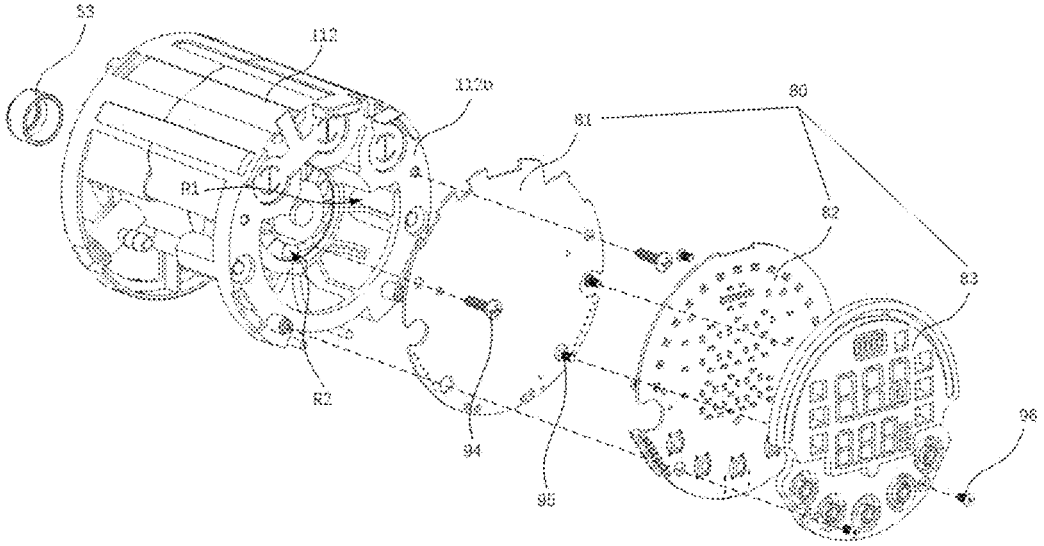
FIG. 12 is another isometric exploded view of the support member.

Specifically, as illustrated in FIG. 11, both the display area 71 and the control buttons 72 can be implemented by a circuit module 80 fixed to the second end member 1121*b*. The circuit module 80 may integrate appropriate electronic components and functional circuits as needed in actual use and may include one or more components (e.g., a button circuit capable of detecting touch operations, a display screen module for presenting visual information, and control circuitry, etc.). In one embodiment, as shown in FIG. 12, a proper gap R1 may be formed between the circuit module 80 and the second spacer member 1122*b*, allowing air to smoothly flow into the air duct R2 located within the first mounting position.

By providing various interaction components on the second end surface of the air pump, the user can conveniently control and operate the air pump and easily switch between multiple functions, which can significantly enhance the user experience.

9. Regarding the Interaction Process of the Air Pump

Figure 14:
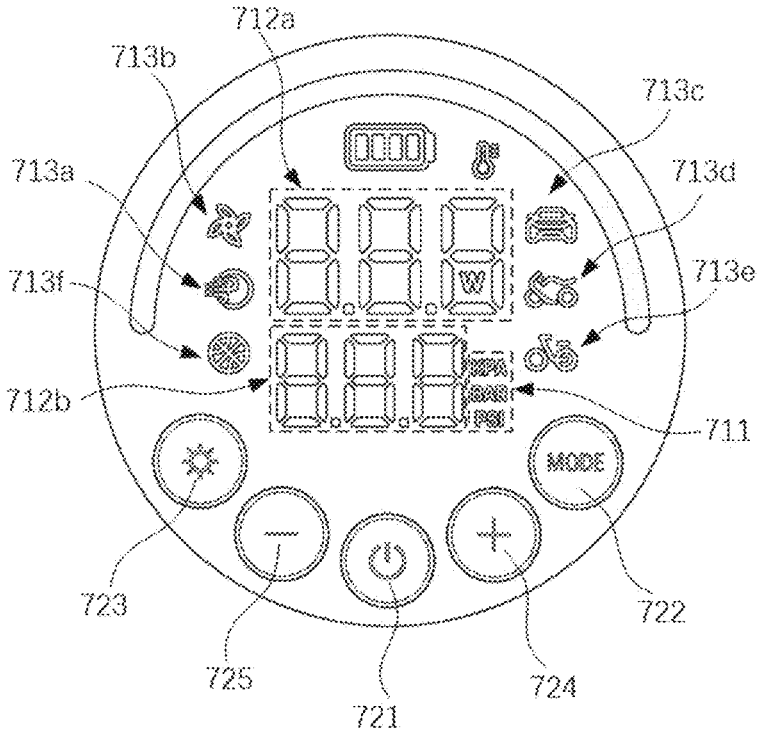
FIG. 14 is a schematic view of the interaction components, showing the specific content of the display area.

FIG. 13 is a schematic diagram of the control buttons 72 according to an embodiment of the present disclosure. FIG. 14 is a schematic diagram of the display area 71 according to an embodiment of the present disclosure. The following describes in detail the interaction process between the user and the air pump during operation, with reference to FIGS. 13 and 14.

In one embodiment, as shown in FIG. 13, the control buttons 72 include a power button 721, a mode selection button 722, a lighting function button 723, a pressure increase button 724, and a pressure decrease button 725. As shown in FIG. 14, the display area 71 may include first visual content 711 indicating the air pressure unit, second visual content indicating the air pressure value, and third visual content indicating multiple inflation, blowing, and suction modes. Specifically, the first visual content 711 displays air pressure units including KPA, BAR, and PSI. The second visual content presents two different font sizes to separately show the real-time air pressure value 712*a* and the preset pressure value 712*b* of the air pump. The third visual content uses distinct icons to visually represent the following modes: blowing mode 713*a*, suction mode 713*b*, inflation mode 713*c* for car tires, inflation mode 713*d* for motorcycle tires, inflation mode 713*e* for bicycle tires, and inflation mode 713*f* for balls.

9.1 Power Off/Power On of the Air Pump

When the air pump is in the powered-off state, the display area 71 is turned off and does not show any feedback information. Only the control buttons 72 are visible on the second end surface of the pump body. At this point, the user can start the air pump by pressing and holding the power button 721, which switches the air pump to the powered-on state. After the air pump is turned on, the interaction interface shown in FIG. 14 will appear on the display area 71.

9.2 Selection of Pressure Units

After the air pump is powered on, the user can switch between the three different pressure units by briefly pressing the mode selection button 722. In the display area 71, the selected pressure unit will be illuminated and visually observable, while the unselected units will remain off and not be displayed.

9.3 Pressure Adjustment

After the air pump is powered on, the user can increase the pressure setting value by briefly pressing the pressure increase button 724, or decrease it by briefly pressing the pressure decrease button 725. The display area 71 will update in real time to show the current pressure setting value 712*b* in response to the user's operation.

9.4 Selection of Inflation Mode

The four inflation modes mentioned above are preset within the air pump to allow users to quickly make adjustments and reduce the frequency and complexity of operations. Each mode is configured with default inflation parameters tailored to its specific application scenario.

Users can switch between the four inflation modes by briefly pressing the mode selection button 722. The icon corresponding to the currently selected mode will be illuminated, while the icons for the unselected modes will not be displayed.

In addition, the second visual content area will simultaneously display the pressure setting value 712*b* associated with the currently selected inflation mode, enabling users to intuitively understand the pressure settings for each mode.

9.5 Free Inflation Mode

After the air pump is powered on, the user can also activate a free inflation mode by briefly pressing the power button 721 once. In the free inflation mode, the air pump immediately begins inflating, and the current real-time pressure value is displayed.

9.6 Illumination Function

The lighting function is designed with a three-state cycling control mode: steady illumination—flashing—off. After the air pump is powered on, the user can activate the lighting function by briefly pressing the lighting button 723. At this point, the lighting device located on the first end surface of the pump body lights up, providing illumination. Pressing the lighting button 723 again switches the air pump to flashing mode, in which the lighting device 60 flashes at a preset frequency to serve as a distress signal. Finally, pressing the lighting button 723 once more while in flashing mode turns off the lighting device, and the lighting device goes out.

9.7 Air Blowing/Suction Function

After the air pump is powered on, the user can switch between the blowing mode, suction mode, and the four preset inflation modes by briefly pressing the mode selection button 722. Similarly, the icon corresponding to the currently selected mode will be illuminated, while the icons of the unselected modes will remain unlit, providing the user with visual feedback on the current operating status of the air pump.

10. Assembly Process of the Air Pump

Taking the exploded view of the air pump shown in FIG. 6 as an example, and referring to FIGS. 5, 9, and 12, the assembly process of the air pump is described in detail as follows.

The assembly process of the support member is as follows: As shown in FIG. 9, the battery cells 431 and the first air driving module 41 are respectively inserted into the mounting holes H1 and the battery cell slots H2 of the first cell support 112*a* and the second cell support 112*b*. Then, screws 91 are used to fasten and secure the first cell support 112*a* and the second cell support 112*b* together. Finally, a first negative nickel contact 411 and a first connecting nickel contact 412 are spot-welded to the ends of the battery cells 431 on the side of the first cell support 112*a*. Likewise, a second negative nickel contact 413 and a second connecting nickel contact 414 are spot-welded to the ends of the battery cells 431 on the side of the second cell support 112*b*. Through this process, multiple battery cells 431 are connected in series to form a single energy storage module. As a result, the assembled support member equipped with battery cells and the first air driving module, as illustrated in FIGS. 7 and 8, is obtained.

Figure 10:
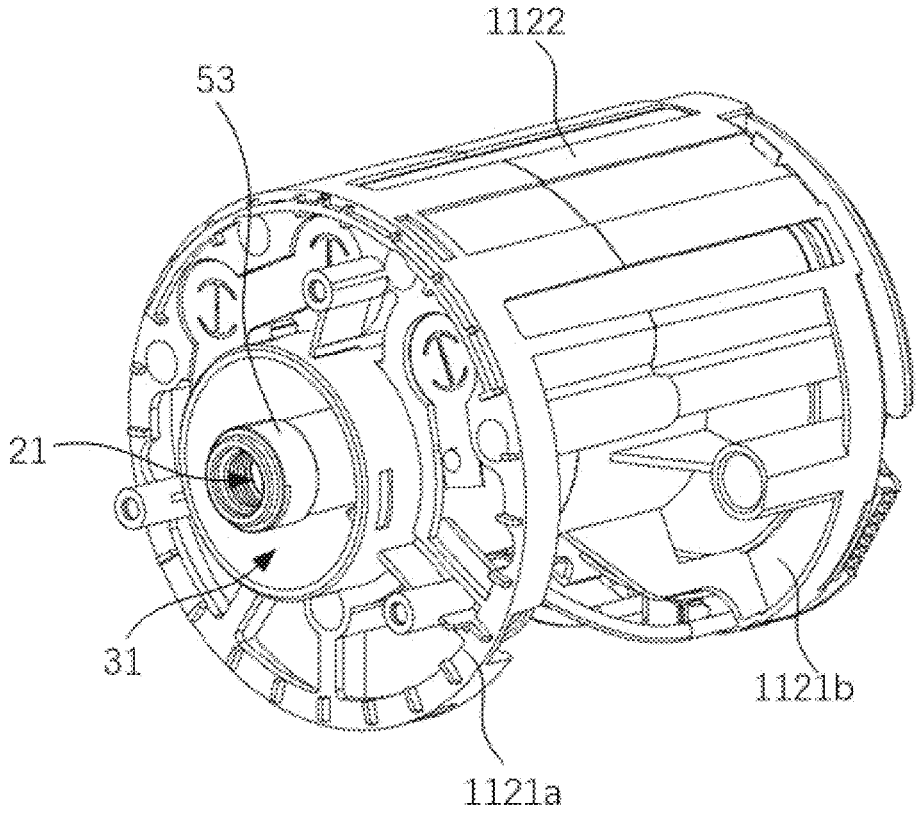
FIG. 10 is a schematic isometric view of the support member.

As shown in FIG. 12, screws 94 are used to secure a first circuit board 81 to the second end member of the second cell support 112*b*, where the second negative nickel contact 413 and the second connecting nickel contact 414 have already been welded. Next, screws 95 are used to lock a second circuit board 82 and a screen bracket 83 together. Finally, screws 96 are used to stack and fasten the already locked second circuit board 82 and screen bracket 83 onto the first circuit board 81, which has already been fixed to the second cell support 112*b*. Additionally, the shock-absorbing pad 53 is arranged around the connector 210. As a result, the assembled support member—now equipped with the shock-absorbing pad and circuit components—is obtained, as shown in FIGS. 10 and 11.

Figure 21:
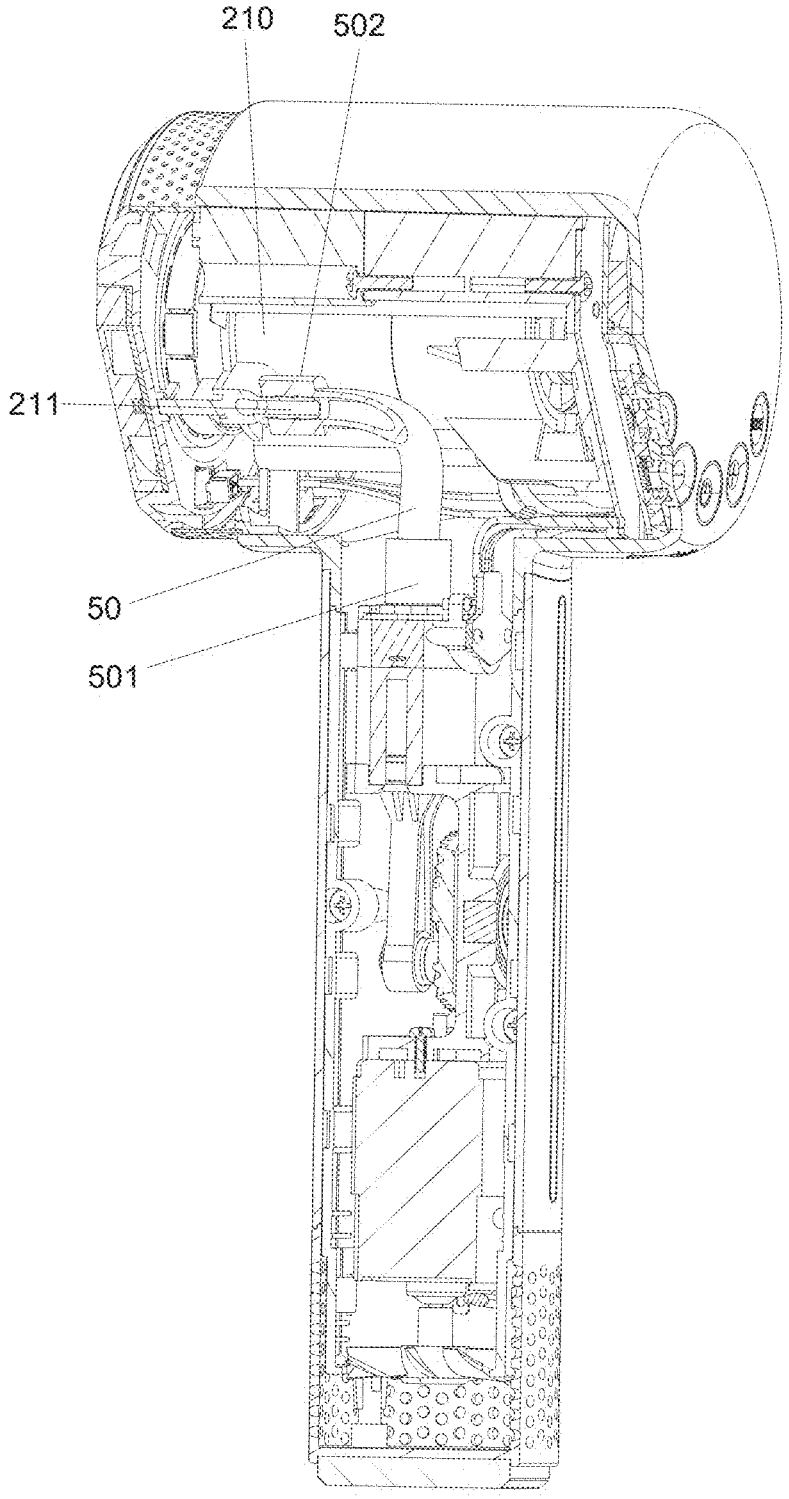
FIG. 21 is a cross-sectional view of the air pump.

As shown in FIG. 6, one end of a connecting tubing 51 (e.g., a hose) is first connected to the compressed air outlet of the second air driving module 42, and then both components are assembled into the housing 111. After that, the other end of the connecting tubing 51 is connected to the connector 210 arranged on the first cell support 112*a*. The support member 111—already equipped with the shock-absorbing pad and circuit components—is then inserted into the housing body 1101 through its open end. Specifically, from the perspective shown in FIG. 21, the lower end 501 of the connecting tubing 51 is connected to the compressed air outlet 421 (see FIG. 6) of the second air driving module 42, while the upper end 502 of the connecting tubing 51 is connected to a connecting member 211 (e.g., a barbed connector, as seen in FIGS. 21 and 11) of the connector 210. Thus, air flowing out of the second air driving module 42 can flow through the connecting tubing 51 to the connecting member 211 and finally flow out of the pump body 10 through the inflation port 21. In one embodiment, the connector 210 can be an independent component and can be connected to the pump body 10 using any suitable connection means. In another embodiment, the connector 210 can be integrally formed with the pump body 10.

At this point, the multiple latches arranged circumferentially at the open end of the housing body 1101 engage with the corresponding latch slots on the first cell support 112*a*, thereby securing the support member 112 within the housing body 1101. Furthermore, screws may be used to firmly lock the support member 112 inside the housing body 1101, ensuring a stable and reliable connection between the support member 112 and the housing body 1101.

As shown in FIG. 5, screws 92 are used to fasten the half case 121*b* of the inner case 121 to the half case 121*a* of the inner case 121, forming a complete inner case 121. Next, the outer case 122 and the connecting ring 123 are successively arranged onto the inner case 121. The connecting ring 123 is then securely fastened to the inner case 121 using screws. Finally, the end cover 124 is fitted and secured at the bottom opening of the connecting ring 123, completing the assembly of the grip portion.

Figure 18:
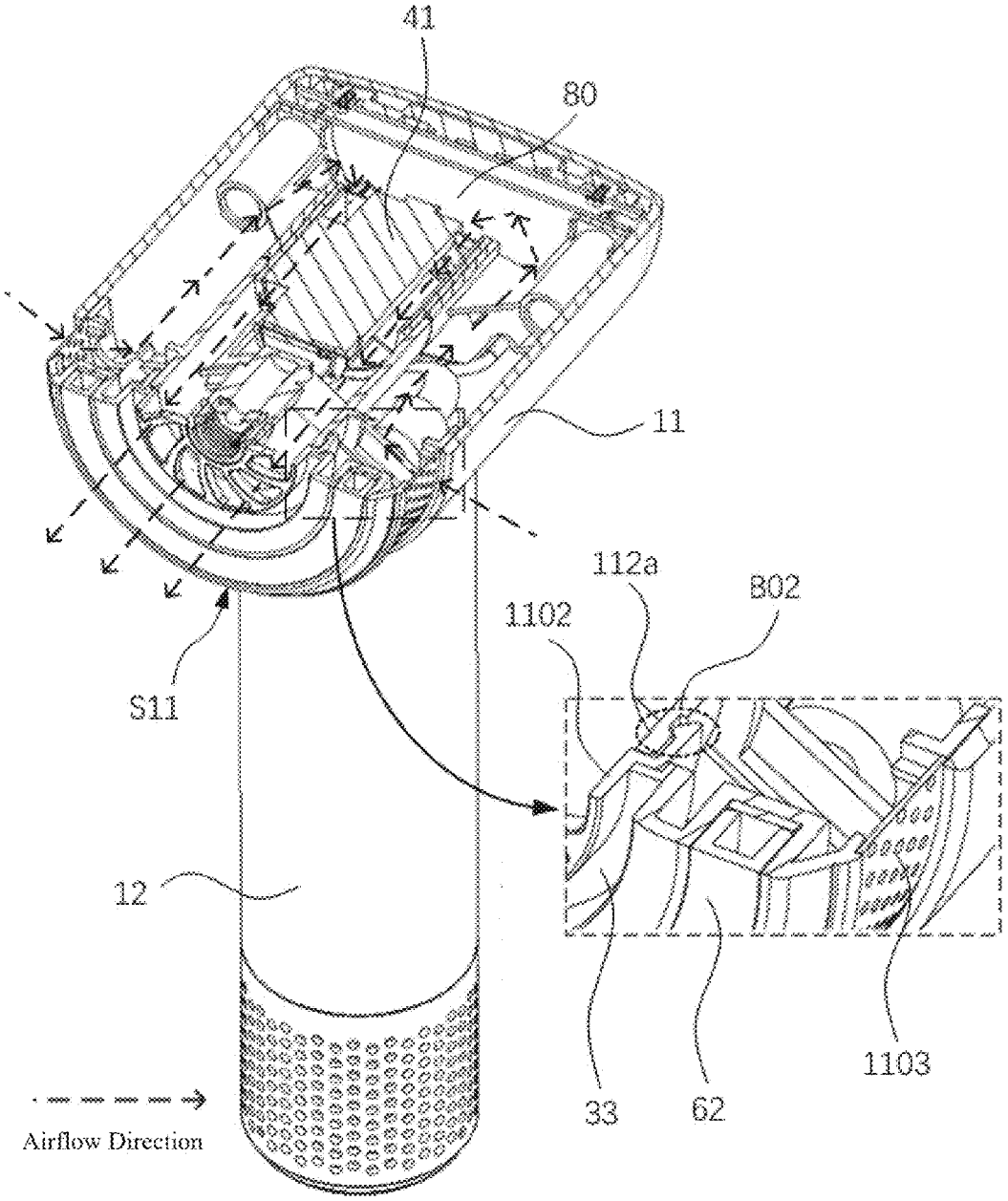
FIG. 18 is another partial sectional view of the air pump, showing the airflow direction during the air blowing process.

Referring to FIG. 5, the connecting ring 1103 is assembled onto the open end of the housing body 11, and the cover plate 1102 is secured to one end of the support member 112. Specifically, as shown in FIG. 18, the cover plate 1102 and the first cell support 112*a* are fastened together via second latches B02, forming a fixed connection by means of snap-fit engagement. Multiple second latches B02 may be provided, evenly distributed around the circumference of the cover plate and the first cell support 112*a*.

Next, the light circuit board 61 is installed into the light slot formed in the cover plate 1102. Using screws for fastening, the light circuit board 61 and the cover plate 1102 are jointly secured to the end member of the support member. Finally, the light cover 62 is detachably secured above the light slot of the cover plate 1102, for example by snap-fit connection, so that it is arranged over the light circuit board 61, completing the assembly of the main body.

11. Airflow Path of the Air Pump

Figure 15:
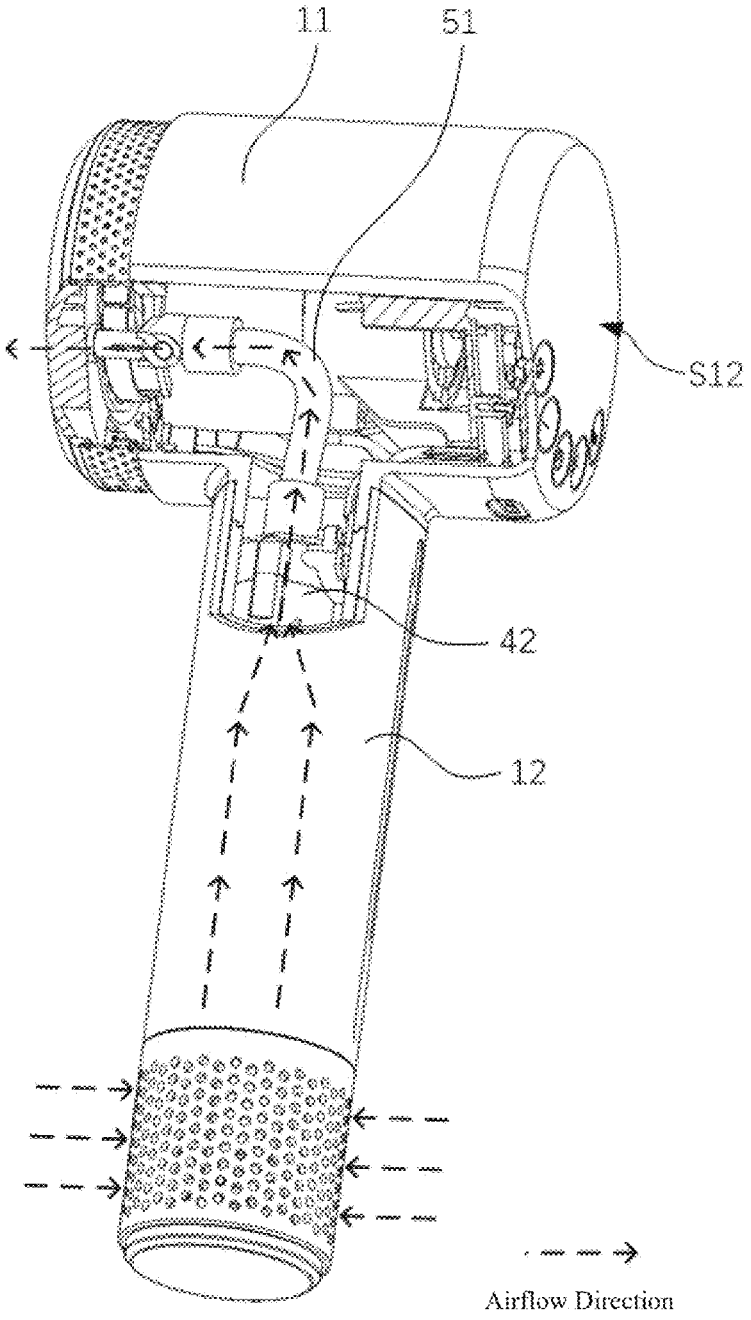
FIG. 15 is a partial sectional view of the air pump according to one embodiment, showing the airflow direction during the inflation process.
Figure 16:
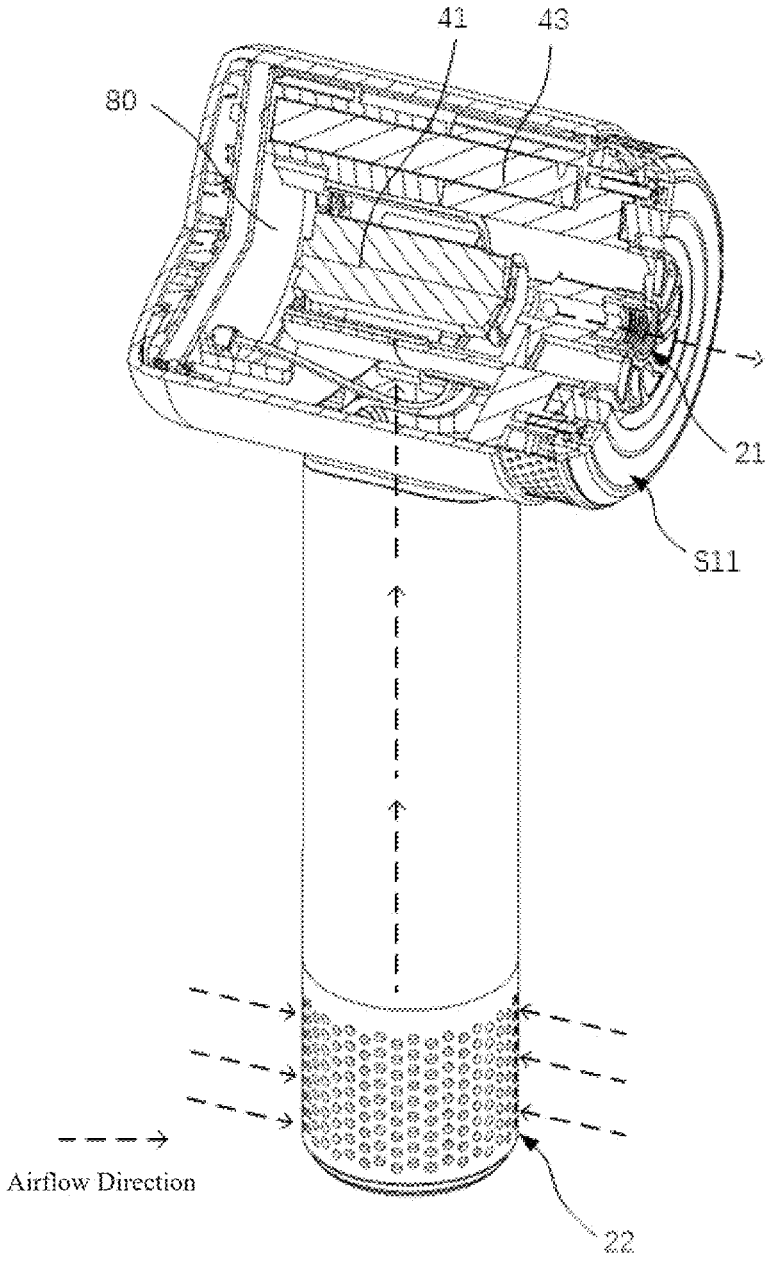
FIG. 16 is another partial sectional view of the air pump, showing the airflow direction during the inflation process.

During the inflation operation of the air pump, as shown in FIGS. 15 and 16, external air is drawn into the interior of the grip portion 11 through the air inlet 22. After being compressed by the second air driving module 42 housed within the grip portion 11, the compressed air is exhausted from the top of the second air driving module 42. It then flows through the connecting tubing 51, which bends approximately 90 degrees, reaching the connector 210 located at the end of the first end member, and is finally pumped out through the inflation port 21.

Figure 17:
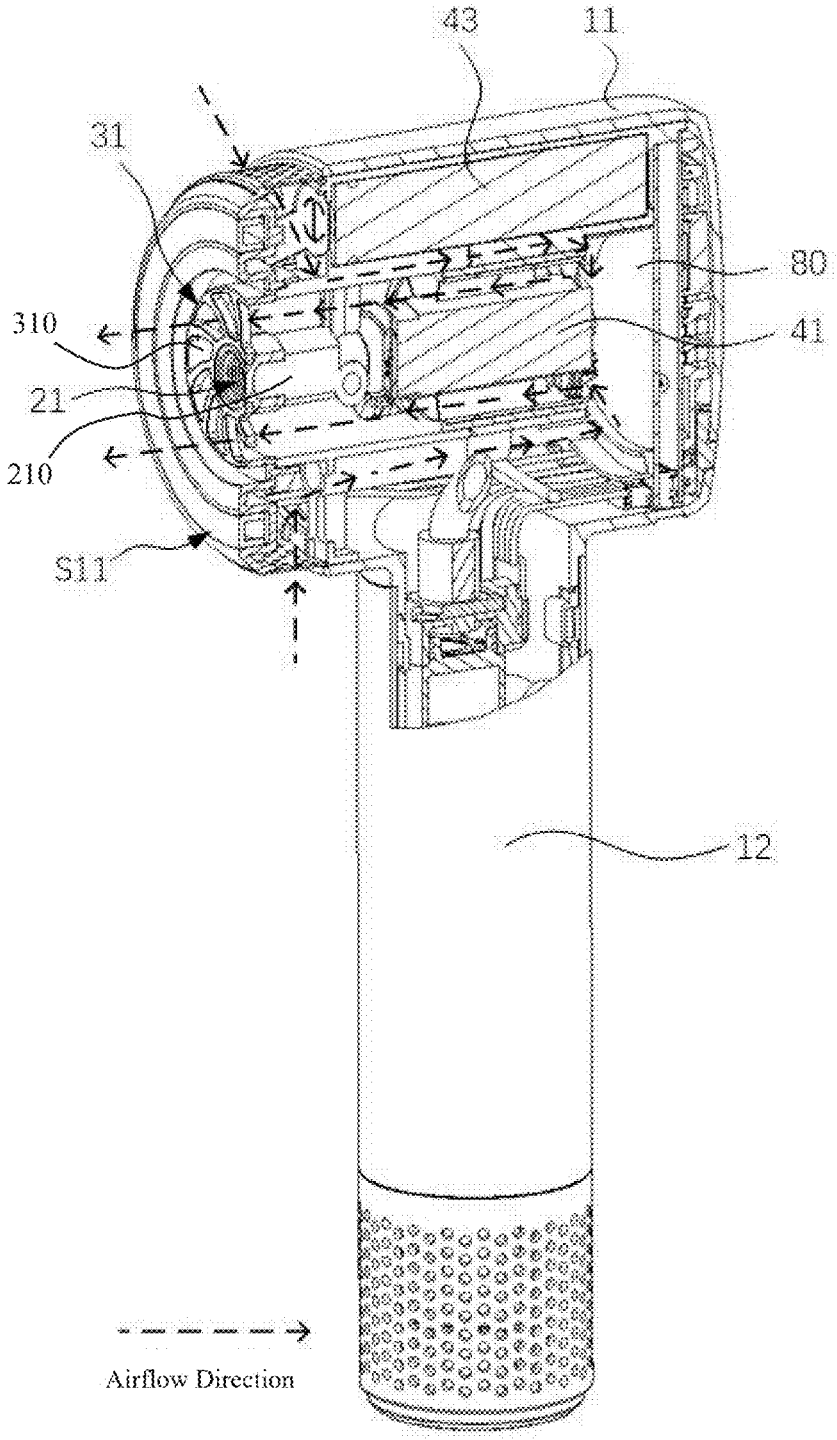
FIG. 17 is a partial sectional view of the air pump, showing the airflow direction during the air blowing process.

During the air blowing operation of the air pump, as shown in FIGS. 17 and 18, driven by the first air driving module 41, external air enters the space between the housing 111 and the support member 112 through the second opening 32 formed in the connecting ring 1103. Then, the air flows through the gap between the second spacer member and the circuit module 80 into the internal air duct at the first mounting position. Finally, the air is accelerated and blown out from the first opening 31 formed at the first end member.

Figure 19:
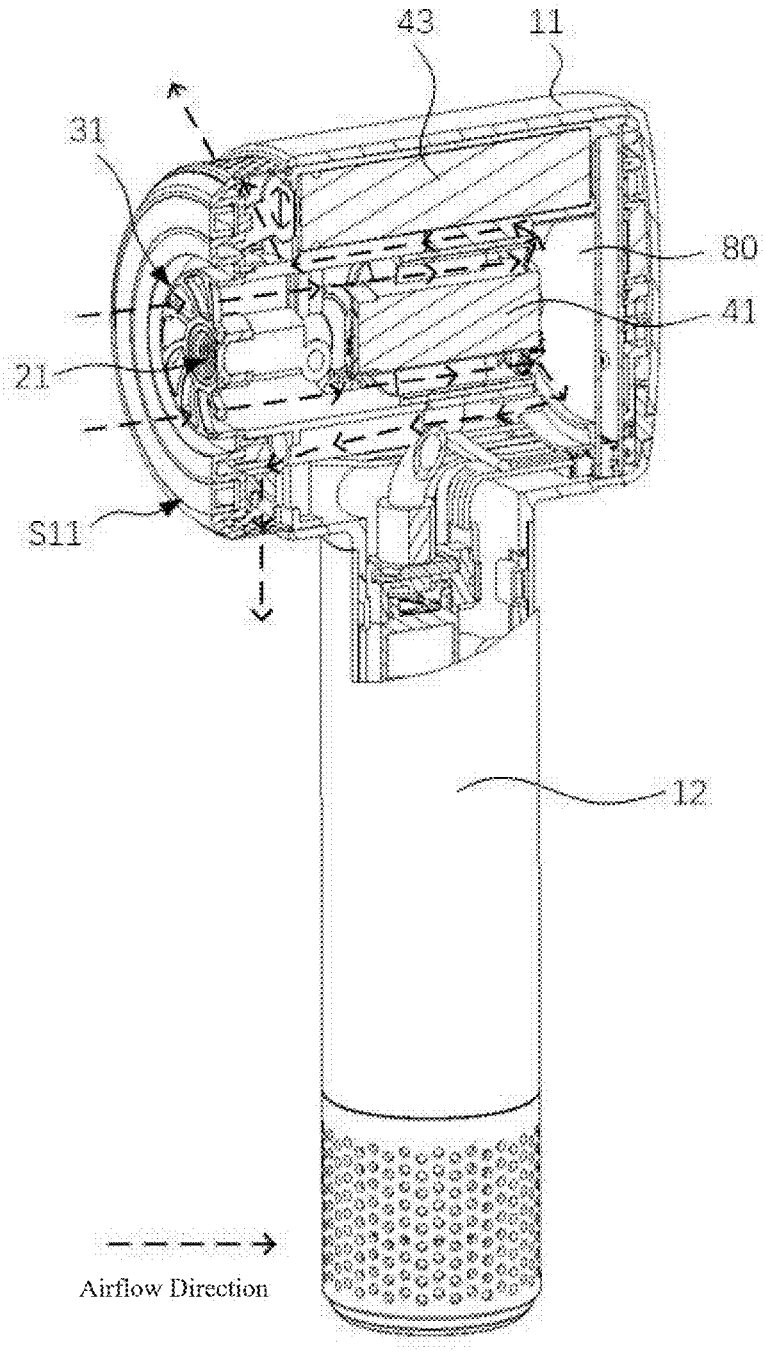
FIG. 19 is a partial sectional view of the air pump, showing the airflow direction during the air suction process.
Figure 20:
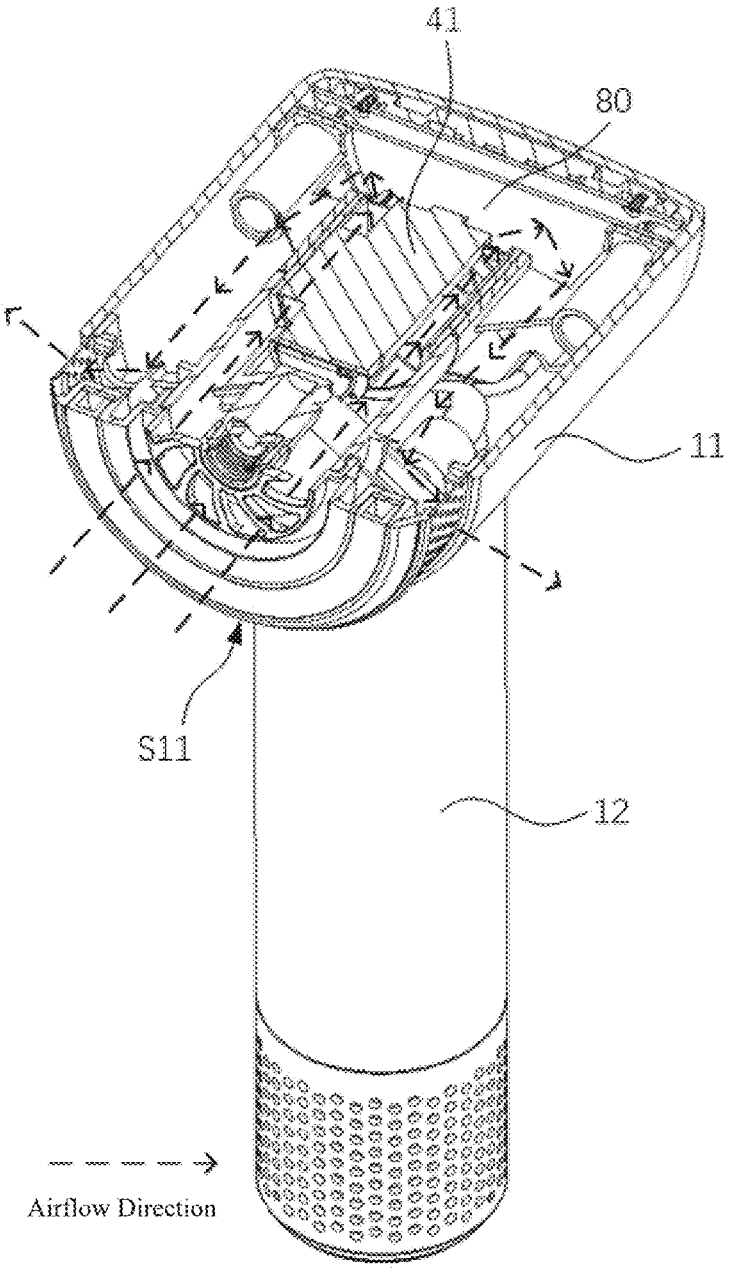
FIG. 20 is another partial sectional view of the air pump, showing the airflow direction during the air suction process.

During the air suction operation of the air pump, as shown in FIGS. 19 and 20, the first air driving 41 provides a reverse driving force, causing external air to enter the internal air duct at the first mounting position through the first opening 31. Then, the air flows through the gap between the second spacer member and the circuit module 80 into the space between the housing 111 and the support member 112. Finally, it exits the main body 11 through the second opening 32 formed in the connecting ring.

12. Connection Method Between the Air Pump and the Nozzle Accessories

Based on one or more of the above-described embodiments of the air pump, the present disclosure further provides a series of nozzle accessories designed for use in conjunction with the air pump. These nozzle accessories can be detachably connected to the air pump to meet the needs of various usage scenarios.

Figure 22:
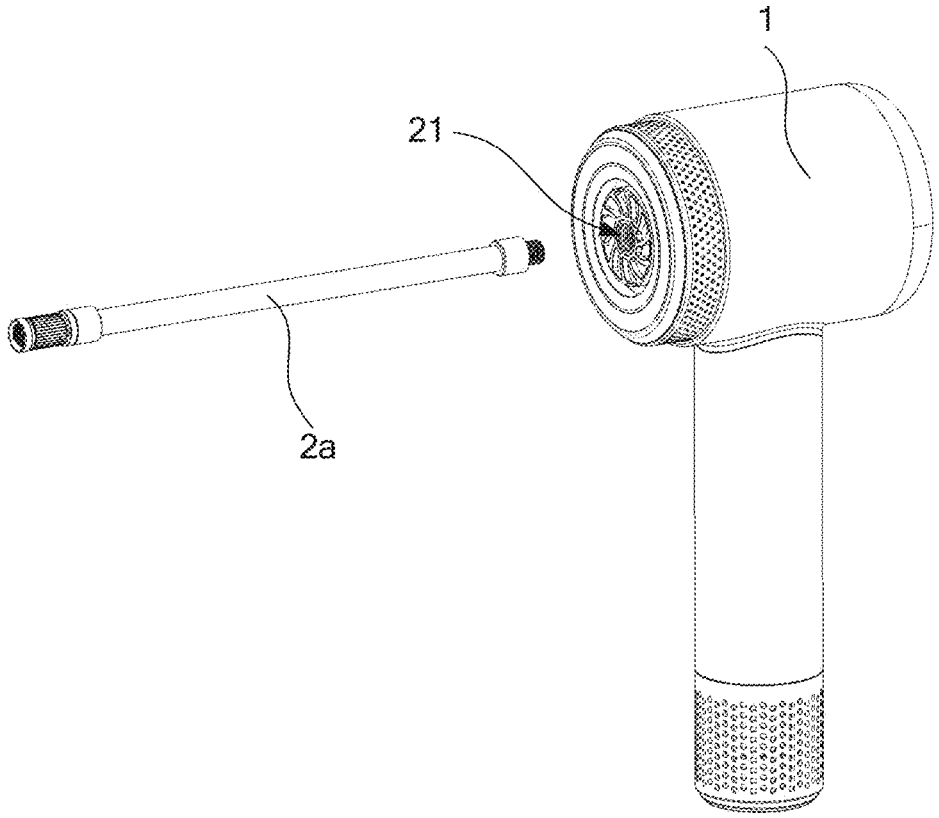
FIG. 22 is a schematic isometric view of an air pump assembly according to one embodiment.

FIG. 22 is a schematic isometric view of an air pump assembly according to an embodiment of the present disclosure. As shown in FIG. 22, the inflation port 21 of the air pump 1 adopts a threaded interface (i.e., internal threads). One end of the external tubing 2*a* (e.g., a hose) is connected to the inflation port 21 via threaded connection, while the other end of the external tubing 2*a* is connected to the object to be inflated (e.g., a tire or a ball) so as to complete the inflation operation.

Figure 23:
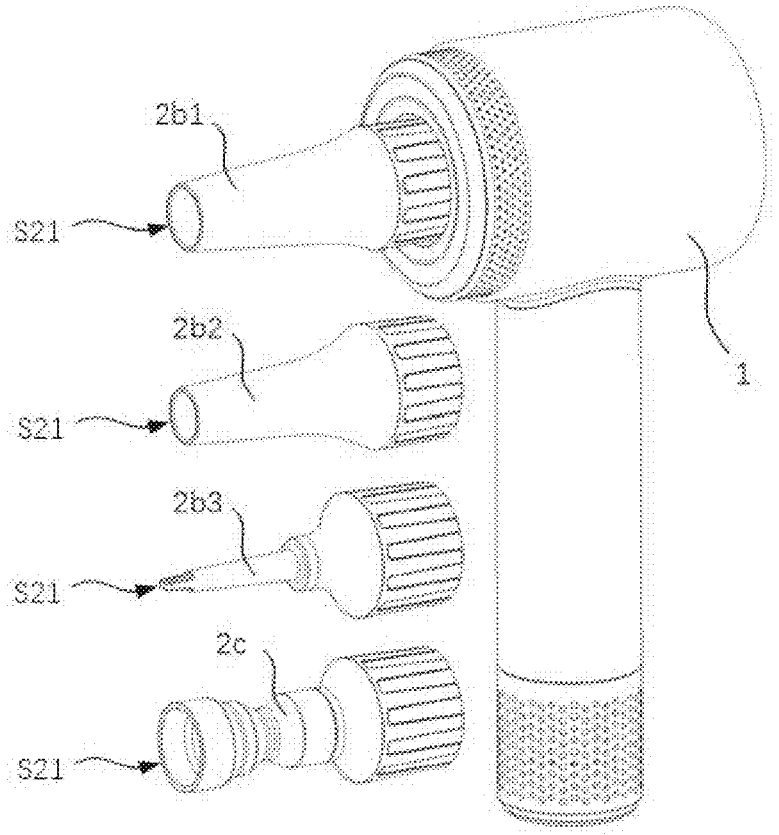
FIG. 23 is a schematic isometric view of an air pump assembly according to another embodiment.

FIG. 23 is a schematic isometric view of the air pump assembly according to another embodiment of the present disclosure. It illustrates not only the external tubing used during the inflation function, but also various nozzle accessories used in conjunction with the air pump during the air-blowing and air-suction functions. As shown in FIG. 23, the nozzle accessories include three types of air-blowing nozzles with different outlet diameters, as well as an air-suction nozzle accessory 2*c*. It should be noted that those skilled in the art may choose to provide additional nozzle accessories in different quantities or specifications as needed for actual applications, and such variations are not specifically limited herein.

In the present disclosure, for the sake of simplicity, the air-blowing nozzle accessory with the largest outlet diameter is referred to as the "first air-blowing nozzle accessory 2b1," the one with a medium outlet diameter is referred to as the "second air-blowing nozzle accessory 2b2," and the one with the smallest outlet diameter is referred to as the "third air-blowing nozzle accessory 2b3."

The first air-blowing nozzle accessory 2b1 can be used in scenarios involving relatively large inflatable objects (e.g., air beds and inflatable boats). The second air-blowing nozzle accessory 2b2 is suitable for medium to small inflatable items (e.g., inflatable pillows and air mattresses). The third air-blowing nozzle accessory 2b3 is used for small inflatable objects (e.g., swim rings or small inflatable toys) or for air-blowing cleaning purposes. The air-suction nozzle accessory 2c can be applied in scenarios requiring rapid deflation of inflatable items or vacuuming of vacuum storage bags. It can quickly extract residual air from the target item to reduce its volume.

Conventionally, detachable connection methods such as snap-fit or magnetic attachment are used between the main air-blowing/suction device and the corresponding nozzle accessories. However, during the development of the air pump of the present disclosure, the inventor(s) identified several issues associated with these conventional connection methods. Specifically, when using snap-fit or magnetic connections, it is difficult to ensure that the nozzle accessories have appropriate retention force or assembly torque. For example, an overly tight snap-fit can provide sufficient assembly torque, but it also makes disassembly difficult. Conversely, a loose snap-fit results in excessive gaps at the connection point, which can cause unwanted noise. Similarly, if the magnetic connection is designed with excessive magnetic force, it becomes difficult to detach the nozzle accessories. On the other hand, if the magnetic force is too weak, it cannot withstand the airflow pressure. This may lead to nozzle accessories detaching during high-power air-blowing operations.

In view of the above, the present disclosure adopts an inflation nozzle with a threaded interface and specifically provides nozzle accessories with dedicated structural designs, so as to form a reliable and easy-to-assemble/disassemble connection between the nozzle accessories and the air pump, thereby effectively overcoming the drawbacks of conventional snap-fit and magnetic connection methods.

Figure 24:
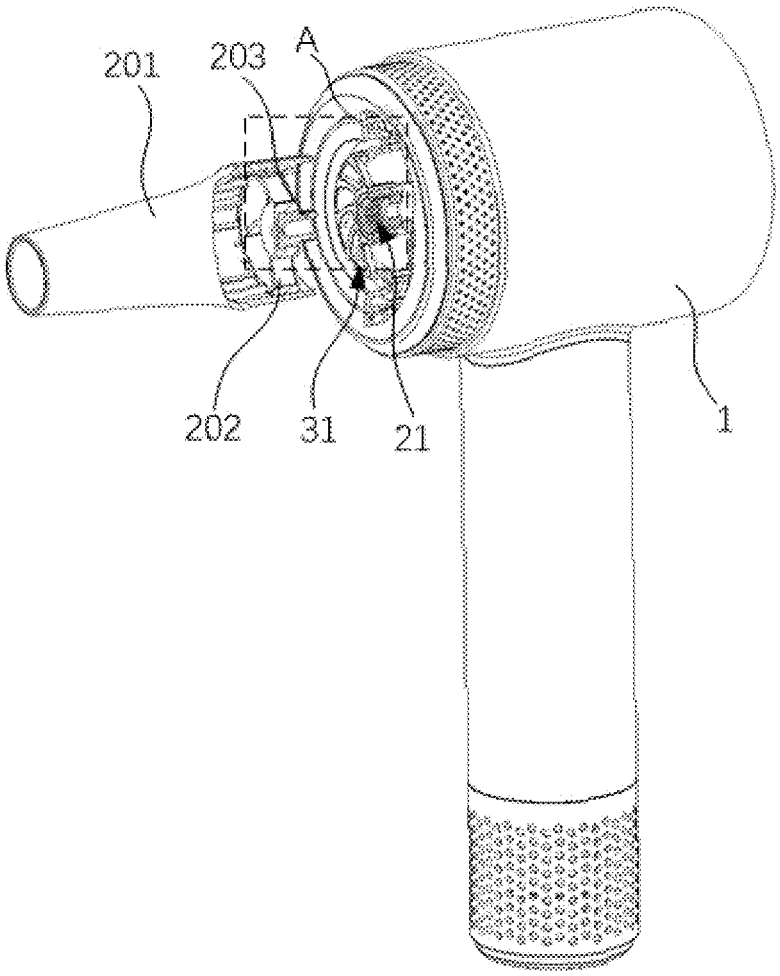
FIG. 24 is a schematic isometric view of the air pump and a first air-blowing nozzle accessory according to one embodiment.
Figure 25:
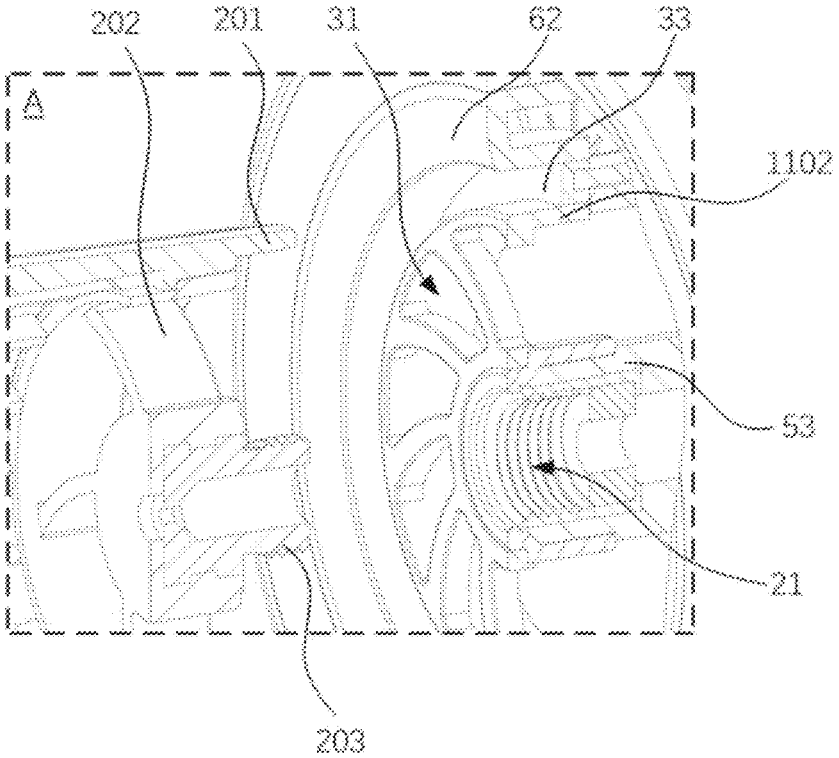
FIG. 25 is a partially enlarged view of a portion A in FIG. 24.
Figure 26:
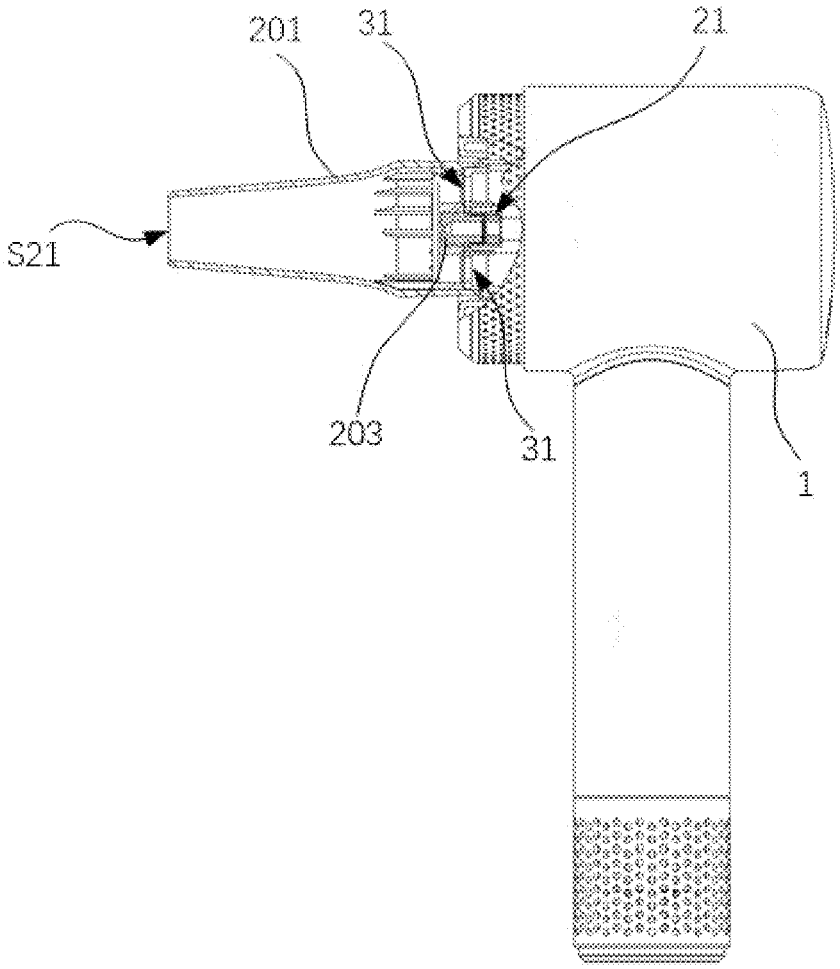
FIG. 26 is a partial cross-sectional view of an assembly including the air pump and the first air-blowing nozzle accessory.

The following provides a detailed description of the specific structural configuration of the nozzle accessory and its connection with the air pump, with reference to FIGS. 24 to 26, using the first air-blowing nozzle accessory 2b1 as an example. In one embodiment, as shown in FIGS. 24 and 25, the nozzle accessory may include a main body 201, a bracket 202, and a threaded fastener 203.

The main body 201 is a hollow component with openings at two opposite ends, allowing air to pass or flow through it. Due to variations in the cross-sectional dimensions of the main body 201, the air undergoes changes in velocity and pressure—either increasing or decreasing—during the flow process. The two axially opposite end surfaces of the main body 201 are referred to as the "working end surface S21" and the "engagement end surface S22", respectively. The working end surface S21 is configured with an air outlet, while the engagement end surface S22 is designed to engage with the first end surface of the air pump.

Specifically, the engagement end surface S22 is dimensioned appropriately so that, when the nozzle accessory is mounted and secured onto the air pump, the first opening 31 of the air pump is completely covered.

The bracket 202 is fixed inside the main body 201. It serves as a mounting support frame, providing structural rigidity and forming a mounting location for the threaded fastener 203. At least part of the structure of the bracket 202 is hollowed out, allowing air to flow through smoothly. Specifically, the bracket 202 can be fixed to the main body 201 using any suitable type of fastening method, including but not limited to ultrasonic welding, snap-fit connection, adhesive bonding, or interference fit.

The threaded fastener 203 is a reliable connecting structure that protrudes from the bracket 202. It is designed with dimensions and shape compatible with the inflation port 21, allowing the user to screw the nozzle accessory into the air pump. Through this screwing action, the threaded fastener 203 engages with the inflation port 21 to form a threaded connection. In actual use, as shown in FIG. 26, when the threaded fastener 203 is securely fastened to the inflation port 21, the engagement end surface of the main body 201 closely abuts against the end surface of the air pump 1. At the same time, the first opening 31 of the air pump is entirely covered by the main body 201, forming a continuous airflow channel. This configuration enables air to be blown out from the air outlet on the working end surface of the main body.

Referring again to FIG. 25, in one embodiment, to further enhance the airtightness of the connection between the air pump 1 and the nozzle accessory 2, the contact area 33, where the first end surface of the pump body 10 meets the engagement end surface of the main body 201, can be designed with a certain degree of elastic deformability. With this configuration, when pressure is exerted between the main body 201 and the pump body 10, the elastically deformable contact area can undergo deformation to fully fill any gaps that may exist between the two components, thereby providing improved sealing performance and better airtightness.

Specifically, the elastically deformable contact area on the first end surface of the pump body 10 can be implemented in various ways. For example, using two-color injection molding technology, the contact area of the cover plate 1102 can be made from a soft rubber material. Alternatively, an annular structure made of soft rubber material with elastic deformability can be fabricated separately and then fixed onto the cover plate 1102 by bonding or other suitable fastening methods, thereby forming a contact area with elastic deformation capability.

It should be noted that although FIGS. 24 to 26 take the first air-blowing nozzle accessory 2b1 as an example to describe the airtight connection method between the nozzle accessory and the pump body, based on the same inventive concept, the second air-blowing nozzle accessory 2b2, the third air-blowing nozzle accessory 2b3, and the air-suction nozzle accessory 2c shown in FIG. 22 can also adopt the same structural design and be airtight connected to the air pump 1 through the same connection method.

Figure 27:
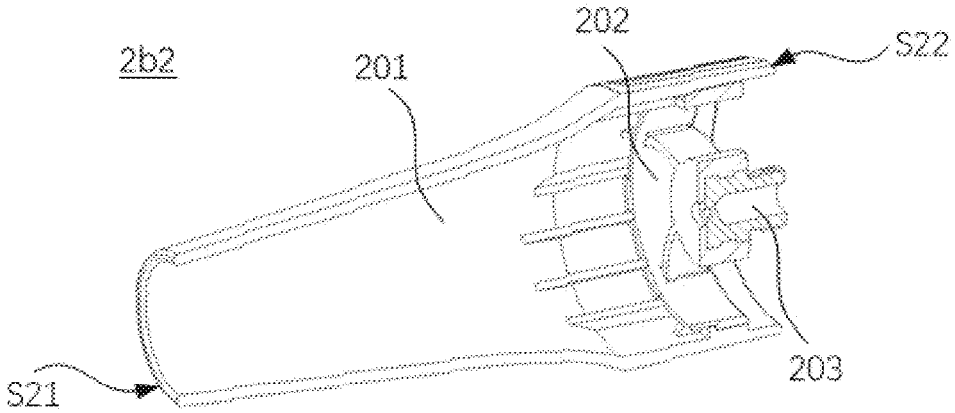
FIG. 27 is a cross-sectional view of a second air-blowing nozzle accessory according to one embodiment.
Figure 28:
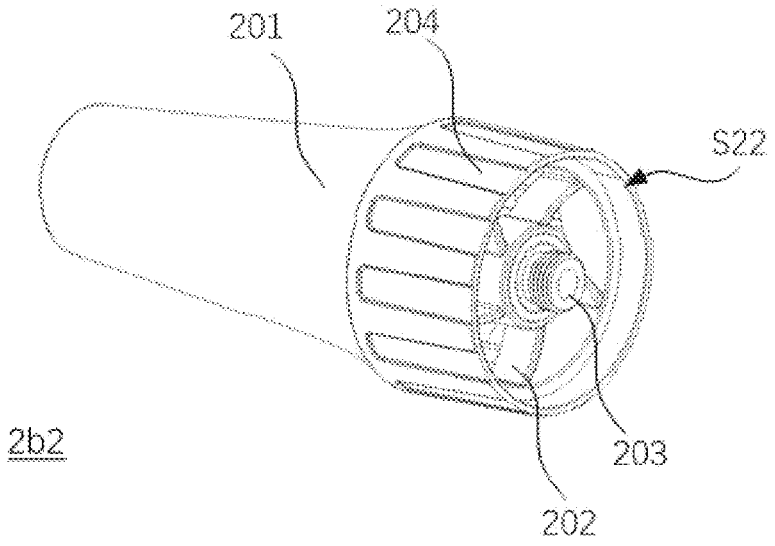
FIG. 28 is a schematic isometric view of the second air-blowing nozzle accessory.

FIGS. 27 and 28 respectively illustrate a cross-sectional view and a schematic isometric view of the second air-blowing nozzle accessory 2b2 according to an embodiment of the present disclosure. As shown in FIGS. 27 and 28, the second air-blowing nozzle accessory 2b2 likewise includes the main body 201, the bracket 202, and the threaded fastener 203. It can be detachably connected to the air pump 1 via the same threaded connection method as described for the first air-blowing nozzle accessory 2b1. In one embodiment, the outer circumferential surface of the main body 201 may further be provided with additional textured areas 204. These textured areas increase the friction between the user's fingers and the nozzle accessory, facilitating easier twisting and screwing operations.

Referring to FIG. 28, the engagement end surface S22 of the second air-blowing nozzle accessory 2*b*2 can be designed to be structurally identical to the engagement end surface of the first air-blowing nozzle accessory 2*b*1, ensuring interchangeability between the two air-blowing nozzle accessories for easy replacement and use.

Figure 29:
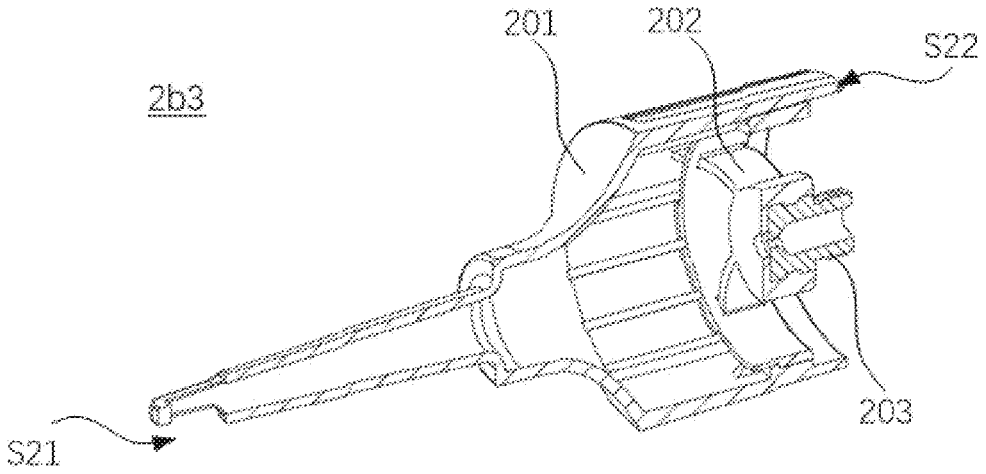
FIG. 29 is a cross-sectional view of a third air-blowing nozzle accessory according to one embodiment.
Figure 30:
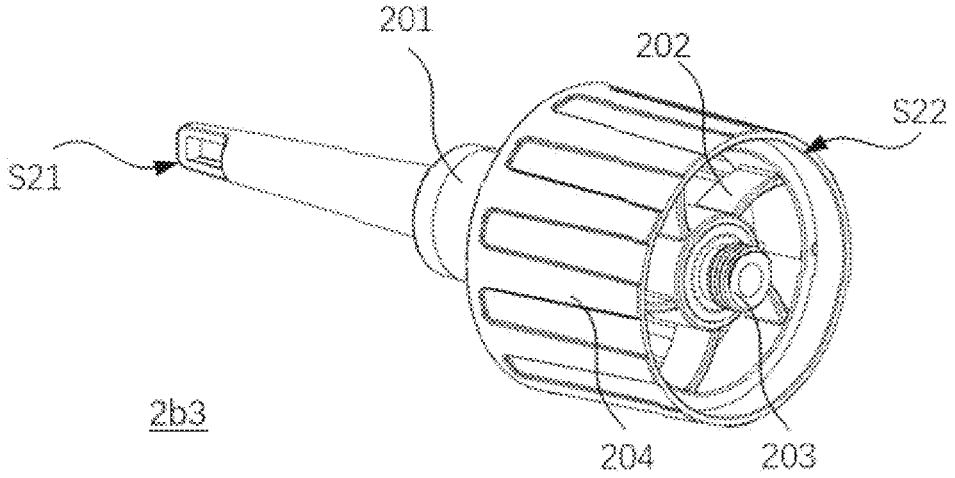
FIG. 30 is a schematic isometric view of the third air-blowing nozzle accessory.

FIG. 29 is a cross-sectional view of the third air-blowing nozzle accessory 2*b*3 according to an embodiment of the present disclosure. FIG. 30 shows a schematic isometric view of the third air-blowing nozzle accessory 2*b*3 according to an embodiment of the present disclosure. As illustrated in FIGS. 29 and 30, unlike the air outlet designs of the first air-blowing nozzle accessory 2*b*1 and second air-blowing nozzle accessory 2*b*2, the third air-blowing nozzle accessory 2*b*3 features a flattened air outlet on its working end surface S21. This design enables deeper insertion into confined spaces.

It should be noted that, the third air-blowing nozzle accessory 2*b*3 includes the main body 201, the bracket 202, and the threaded fastener 203, and includes the same engagement end surface S22 as the second air-blowing nozzle accessory 2*b*2 to ensure the interchangeability of the nozzle accessories.

Figure 31:
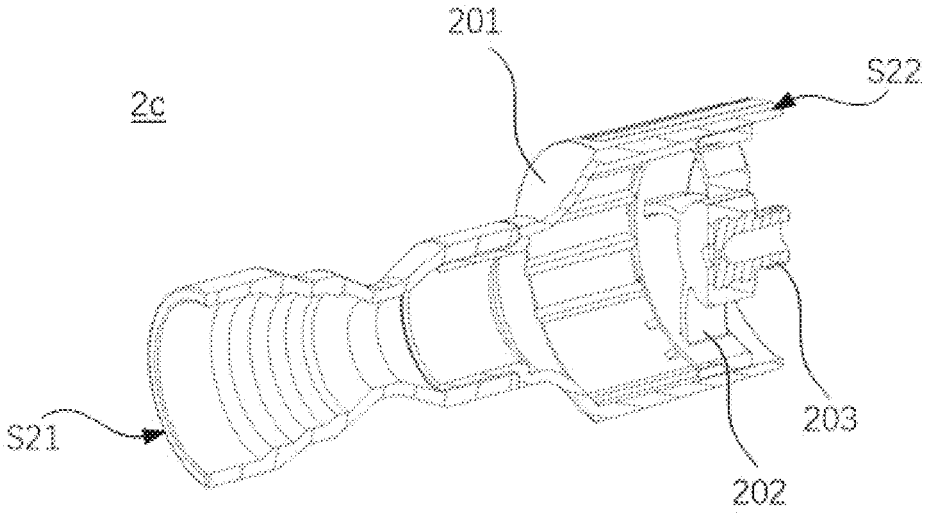
FIG. 31 is a cross-sectional view of an air-suction nozzle accessory according to one embodiment.
Figure 32:
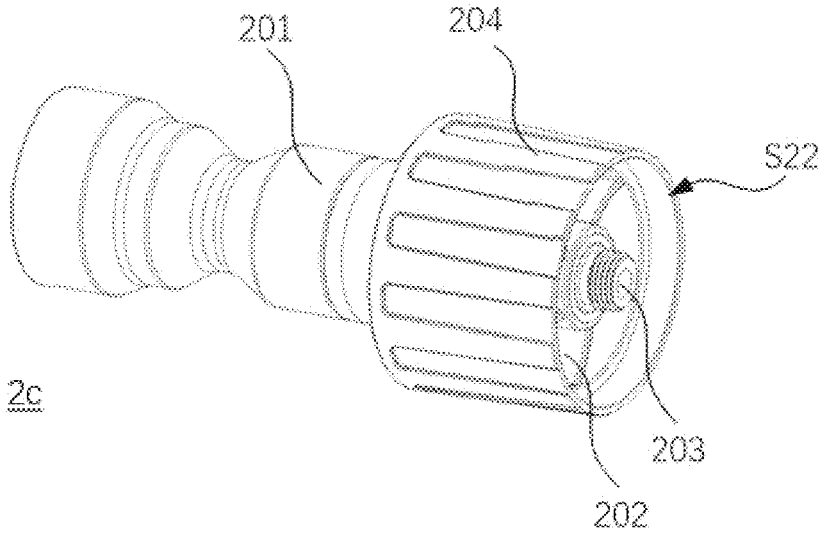
FIG. 32 is a schematic isometric view of the air-suction nozzle accessory.
Figure 33:
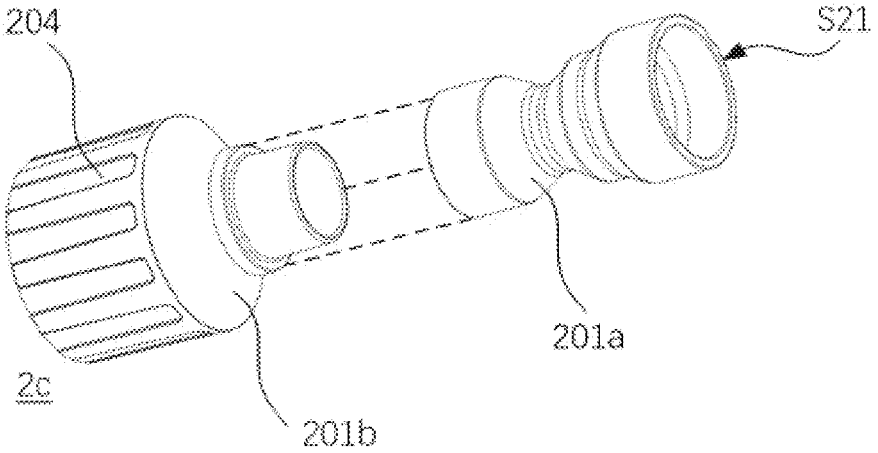
FIG. 33 is a schematic isometric exploded view of an air-suction nozzle accessory according to another embodiment.

FIG. 31 is a cross-sectional view of the air-suction nozzle accessory 2*c* according to an embodiment of the present disclosure. FIG. 32 is a schematic isometric view of the air-suction nozzle accessory 2*c* according to an embodiment of the present disclosure. FIG. 33 is an isometric exploded view of the air-suction nozzle accessory 2*c* according to an embodiment of the present disclosure.

As shown in FIGS. 31 and 32, the air-suction nozzle accessory 2*c* likewise includes the main body 201, the bracket 202, and the threaded fastener 203. It includes an identical engagement end surface S22 to that of the first, second, and third air-blowing nozzle accessories 2*b*1, 2*b*2, and 2*b*3, ensuring interchangeability among all nozzle accessories. Unlike the air-blowing nozzle accessories, the air-suction nozzle accessory features an air inlet formed on its working end surface S21. This allows it to generate localized negative pressure, thereby enabling air suction functionality.

In one embodiment, the air-suction nozzle accessory 2*c* may be designed as a detachable and separable component, achieving benefits such as easier part replacement and improved adaptability. As shown in FIG. 33, the main body 201 may include a first portion 201*a* and a second portion 201*b*. The first portion 201*a* and the second portion 201*b* are two separate components that can be detachably connected to each other. The bracket 202, threaded fastener 203, and textured areas 204 are arranged on the first portion 201*a*, while the second portion 201*b* forms the working end surface S21 and is provided with an air inlet. As a result, users can independently replace the second portion 201*b* without changing the first portion 201*a*, according to actual needs, to accommodate different usage scenarios. Alternatively, the first portion 201*a* and the second portion 201*b* can be separated to facilitate cleaning of internal components such as the filter or sealing ring within the air-suction nozzle accessory 2*c*.

In the present disclosure, the correlations and interrelationships between different embodiments are described and disclosed in detail. Based on these descriptions, those skilled in the art can understand and determine whether the technical features involved in different embodiments are in conflict with one another.

Furthermore, when the technical features of different embodiments are not explicitly described or indicated as being in conflict within the context of their correlations and interrelationships, they may be combined with each other to obtain additional embodiments. These embodiments, obtained through such straightforward combinations, all fall within the scope of the present disclosure.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. An air pump comprising:

a pump body defining a first opening and an air vent in different positions and an airflow channel in communication with the first opening and the air vent; the airflow channel formed internally within the pump body;

a connector connected to the pump body, the connector defining an inflation port;

an airflow driving device arranged within the pump body, the airflow driving device configured to perform the following operations:

compressing air drawn into the pump body through the air vent and pump the air out through the inflation port;

allowing the air to enter the pump body through the inflation port and be exhausted through the air vent;

driving the air to enter the pump body from the first opening, flow through the airflow channel and exit the pump body from the air vent; and driving the air to enter the pump body from the air vent, flow through the airflow channel and exit the pump body from the first opening.

2. The air pump of claim 1, wherein the inflation port and the first opening are located on an end surface of the pump body.

3. The air pump of claim 2, wherein the inflation port is located at a central position of the end surface of the pump body, and the first opening comprises a plurality of first through holes that are arranged to surround the inflation port.

4. The air pump of claim 1, wherein the pump body comprises a main body extending along a main axis and a grip portion extending outward from the main body and extending at a preset angle to the main axis; the main body comprises a first end surface and a second end surface opposite to the first end surface, and the inflation port and the first opening are located on the first end surface.

5. The air pump of claim 4, wherein the air vent comprises an air inlet and a second opening; the airflow driving device comprises:

a first air driving module configured to: drive the air to enter the pump body from the first opening, flow through the airflow channel and exit the pump body from the second opening; or drive the air to enter the pump body from the second opening, flow through the airflow channel and exit the pump body from the first opening;

a second air driving module configured to compress the air drawn into the pump body through the air inlet and pump the air out through the inflation port; or allow the air to enter the pump body through the inflation port and be exhausted through the air inlet; and an energy storage module configured to supply power to the first air driving module and the second air driving module.

6. The air pump of claim 5, wherein the first air driving module and the energy storage module are arranged in the main body; the second air driving module is arranged in the grip portion; the air inlet is defined in the grip portion and the second opening is defined in the main body.

7. The air pump of claim 5, wherein the second opening is located on a peripheral surface of the main body and is arranged radially around the main axis, and the air inlet is located on the grip portion.

8. The air pump of claim 5, wherein the energy storage module comprises a plurality of battery cells, and the main body comprises:

a hollow housing; and a support member, at least a portion of which is physically connected to and fixedly arranged within the housing;

wherein the support member defines a first mounting position and a plurality of second mounting positions, the first air driving module is mounted in the first mounting position, and the battery cells are mounted in the second mounting positions, respectively.

9. The air pump of claim 8, wherein the support member comprises:

a first end member and a second end member that are opposite to and spaced apart from each other;

a first spacer member extending from the first end member along the main axis, wherein the first spacer member defines a first mounting hole and a plurality of battery cell slots; and a second spacer member extending from the second end member along the main axis, wherein the second spacer member defines a second mounting hole and a plurality of battery cell slots;

wherein the first spacer member and the second spacer member are fixedly joined together, such that the first mounting hole and the second mounting hole cooperatively form the first mounting position, and the battery cell slots of the first spacer member and the second spacer member cooperatively form the second mounting positions.

10. The air pump of claim 9, wherein the inflation port is disposed at a center of the first end member, the housing is provided with a through hole adapted to the inflation port; the inflation port is connected to a compressed air outlet of the second air driving module via one or more connecting tubings.

11. The air pump of claim 9, further comprising a light circuit board and a light cover, wherein the light circuit board is fixed to the first end member and is arranged to surround the first opening, and the light cover is arranged over the light circuit board.

12. The air pump of claim 1, further comprising circuit module arranged within the pump body, wherein the circuit module comprises at least one interaction component at one end of the pump body, and the at least one interaction component comprises a display area and one or more control buttons.

13. The air pump of claim 1, wherein the air driven by the airflow driving device and entering from or exiting through the first opening has a lower air pressure than the air pumped out from the inflation port by the airflow driving device.

14. An air pump comprising:

a pump body defining a first opening and an air vent in different positions, which are in communication with each other;

a connector connected to the pump body, the connector defining an inflation port; and a first air driving module and a second air driving module arranged within the pump body;

wherein the first air driving module is configured to drive air to enter the pump body from the first opening, flow through the airflow channel and exit the pump body from the air vent; and to drive the air to enter the pump body from the air vent, flow through the airflow channel and exit the pump body from the first opening; wherein the second air driving module is configured to compress the air drawn into the pump body through the air vent and pump the air out through the inflation port; and to allow the air to enter the pump body through the inflation port and be exhausted through the air vent; and wherein the air driven by the first air driving module and entering from or exiting through the first opening has a lower air pressure than the air pumped out from the inflation port by the second air driving module.

15. The air pump of claim 14, wherein the inflation port and the first opening are located on an end surface of the pump body.

16. The air pump of claim 15, wherein the inflation port is located at a central position of the end surface of the pump body, and the first opening comprises a plurality of first through holes that are arranged to surround the inflation port.

17. The air pump of claim 14, wherein the pump body comprises a main body extending along a main axis and a grip portion extending outward from the main body and extending at a preset angle to the main axis; the main body comprises a first end surface and a second end surface opposite to the first end surface, and the inflation port and the first opening are located on the first end surface.

18. The air pump of claim 17, wherein the air vent comprises an air inlet and a second opening, the main body comprises a peripheral surface and the second opening is defined in the peripheral surface, and the air inlet is defined in the grip portion.

19. An air pump assembly comprising:

an air pump comprising:

a pump body defining a first opening and an air vent in different positions and an airflow channel in communication with the first opening and the air vent; the airflow channel formed internally within the pump body;

a connector connected to the pump body, the connector defining an inflation port;

an airflow driving device arranged within the pump body, the airflow driving device configured to perform the following operations:

compressing air drawn into the pump body through the air vent and pump the air out through the inflation port;

allowing the air to enter the pump body through the inflation port and be exhausted through the air vent;

driving the air to enter the pump body from the first opening, flow through the airflow channel and exit the pump body from the air vent; and driving the air to enter the pump body from the air vent, flow through the airflow channel and exit the pump body from the first opening; and at least one nozzle accessory, wherein the at least one nozzle accessory is configured to be detachably and threadedly connected to the inflation port.

20. The air pump assembly of claim 19, wherein the at least one nozzle accessory comprises:

a hollow main body defines two open ends that are opposite to each other, a first of the two open ends having a working end surface, and a second of the two open ends having an engagement end surface;

a bracket fixed within the main body, wherein at least a portion of the bracket is hollowed out to allow the air flow through the main body; and a threaded fastener fixed to the bracket, wherein when the threaded fastener is detachably screwed into the inflation port, the engagement end surface abuts against an end surface of the pump body, and the main body covers the first opening.

* * * * *